US011811126B2

(12) United States Patent
Kawano et al.

(10) Patent No.: US 11,811,126 B2
(45) **Date of Patent: *Nov. 7, 2023**

(54) ANTENNA APPARATUS AND RADIO BASE STATION

(71) Applicant: NTT DOCOMO, INC., Tokyo (JP)

(72) Inventors: Yoshiyuki Kawano, Tokyo (JP); Jun Andou, Tokyo (JP); Hiroki Takahashi, Tokyo (JP); Taku Yamazaki, Tokyo (JP); Kensuke Miyachi, Tokyo (JP)

(73) Assignee: NTT DOCOMO, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/455,353

(22) Filed: Nov. 17, 2021

(65) Prior Publication Data

US 2022/0077562 A1 Mar. 10, 2022

Related U.S. Application Data

(63) Continuation of application No. 16/640,935, filed as application No. PCT/JP2018/031420 on Aug. 24, 2018, now Pat. No. 11,349,189.

(30) Foreign Application Priority Data

Aug. 24, 2017 (JP) ..... 2017-161070

(51) Int. Cl.
*H01Q 1/04* (2006.01)
*H01Q 1/12* (2006.01)
(Continued)

(52) U.S. Cl.
CPC ..... *H01Q 1/04* (2013.01); *H01Q 1/12* (2013.01); *H01Q 1/246* (2013.01); *H01Q 1/38* (2013.01);
(Continued)

(58) Field of Classification Search
CPC .. H01Q 1/04; H01Q 1/12; H01Q 1/38; H01Q 3/01; H01Q 3/02; H01Q 21/06; H01Q 21/28
(Continued)

(56) References Cited

U.S. PATENT DOCUMENTS 6,272,346 B1 8/2001 Fujinami
8,643,559 B2 2/2014 Deng et al.
(Continued)

FOREIGN PATENT DOCUMENTS

EP 1223651 A1 7/2002
GN 204927522 U 12/2015
(Continued)

OTHER PUBLICATIONS

Extended European Search Report issued in European Application No. 22185450.8, dated Oct. 31, 2022 (10 pages).
(Continued)

*Primary Examiner* — Hai V Tran
(74) *Attorney, Agent, or Firm* — Osha Bergman Watanabe & Burton LLP

(57) ABSTRACT

An antenna apparatus is disclosed including an antenna element; an installation base being a base where the antenna element is installed; a container including an upper surface that opens and housing the antenna element and the installation base, the upper surface being a surface closest to a ground surface when the container is installed in a ground; and a cover being formed of FRP (Fiber-Reinforced Plastics) and covering an opening of the container, wherein the installation base includes a height adjustment mechanism that adjusts a distance from the antenna element to the cover. In other aspects, a radio base station is also disclosed.

5 Claims, 19 Drawing Sheets

(51) Int. Cl.

| | |
|---|---|
| ***H01Q 1/38*** | (2006.01) |
| ***H01Q 3/01*** | (2006.01) |
| ***H01Q 3/02*** | (2006.01) |
| ***H01Q 21/06*** | (2006.01) |
| ***H01Q 1/24*** | (2006.01) |
| ***H01Q 21/28*** | (2006.01) |

(52) U.S. Cl.
CPC ..... *H01Q 3/01* (2013.01); *H01Q 3/02* (2013.01); *H01Q 21/06* (2013.01); *H01Q 21/28* (2013.01)

(58) Field of Classification Search
USPC ..... 343/719
See application file for complete search history.

(56) References Cited

U.S. PATENT DOCUMENTS

| | | | | |
|---|---|---|---|---|
| 2003/0197651 | A1 | 10/2003 | Yuanzhu | |
| 2008/0309568 | A1 | 12/2008 | Deng et al. | |
| 2009/0027288 | A1* | 1/2009 | Lee | H01Q 21/20 343/766 |
| 2011/0077036 | A1* | 3/2011 | Frank | H01Q 1/2233 343/834 |
| 2014/0085163 | A1 | 3/2014 | Gregg | |
| 2014/0152528 | A1* | 6/2014 | Cameron | H01Q 9/0407 174/37 |
| 2015/0070234 | A1 | 3/2015 | Jones | |
| 2015/0122959 | A1* | 5/2015 | Cook | H01Q 1/12 248/205.1 |

FOREIGN PATENT DOCUMENTS

| | | | |
|---|---|---|---|
| JP | H05-227073 | A | 9/1993 |
| JP | H11-127100 | A | 5/1999 |
| JP | 2000-161600 | A | 6/2000 |
| JP | 2001-197642 | A | 7/2001 |
| JP | 200858245 | A | 3/2008 |
| JP | 2009539298 | A | 11/2009 |
| JP | 2010-258846 | A | 11/2010 |
| JP | 201223886 | A | 2/2012 |

OTHER PUBLICATIONS

Office Action issued in Japanese Application No. 2021-101852; dated Jan. 4, 2023 (4 pages).
International Search Report issued in PCT/JP2018/031420 dated Oct. 16, 2018 (7 pages).
Written Opinion of the International Searching Authority issued in PCT/JP2018/031420 dated Oct. 16, 2018 (3 pages).
Extended European Search Report in counterpart European Application No. 18849174.0 dated Jun. 17, 2020 (10 pages).
Office Action issued in corresponding Chinese Application No. 201880059932.X; dated May 8, 2021 (12 pages).
Office Action in counterpart Japanese Patent Application No. 2019-537713 dated Apr. 20, 2021 (7 pages).
Office Action in counterpart European Patent Application No. 18 849 174.0 dated Mar. 2, 2021 (8 pages).
Office Action issued in corresponding Chinese Application No. 201880059932.X; dated Aug. 17, 2021 (7 pages).
Office Action issued in corresponding Chinese Application No. 201880059932.X; dated Oct. 12, 2021 (14 pages).
Office Action issued in Japanese Application No. 2021-101852; dated Jul. 5, 2022 (8 pages).
Office Action issued in U.S. Appl. No. 16/640,935; dated Dec. 30, 2021 (10 pages).
Office Action in the counterpart Chinese Application No. 202110829287.9, dated Jun. 29, 2023 (17 pages).

* cited by examiner

ANTENNA APPARATUS AND RADIO BASE STATION

CROSS-REFERENCE TO RELATED APPLICATIONS

The present application is a continuation application and, thereby, claims benefit under 35 U.S.C. § 120 to U.S. patent application Ser. No. 16/640,935 filed on Feb. 21, 2020, titled, "ANTENNA APPARATUS, RADIO BASE STATION, AND ANTENNA APPARATUS HOUSING BODY," which is a national stage application of PCT Application No. PCT/JP2018/031420, filed on Aug. 24, 2018, which claims priority to Japanese Patent Application No. 2017-161070 filed on Aug. 24, 2017. The contents of the priority applications are incorporated by reference in their entirety.

TECHNICAL FIELD

The present invention relates to an antenna apparatus and a radio base station.

BACKGROUND ART

Conventionally, in areas where a multitude of buildings, condominium buildings, telephone poles, and the like are present, radio base stations are installed on these buildings, whereas in areas where these buildings are not present (for example, areas around parks or sports grounds), steel tower-like radio base stations are installed. However, it is often the case that in the above-mentioned areas where these buildings are not present, consideration for landscapes is required, and inconspicuously installing the radio base stations is demanded.

As the conventional technology that inconspicuously installs the radio base stations, a manhole type antenna in which a radio base station is installed in a manhole has been known (PTL 1).

CITATION LIST

Patent Literature

PTL 1
Japanese Patent Application Laid-Open No. H5-227073

SUMMARY OF INVENTION

Technical Problem

In a case of the manhole type antenna, since a distance between a human body and an antenna element is short, if in order to widen a communication area, an electric field strength of radio waves is strengthened, it is likely that the specified radio wave protection guidelines are not satisfied. However, as for the manhole type antenna in the conventional technology, no consideration is paid to the radio wave protection guidelines.

An object of the present invention is to provide an antenna apparatus of an underground embedded type which allows adjustment for satisfying the radio wave protection guidelines to be made.

Solution to Problem

An antenna apparatus according to one aspect of the present invention is an antenna apparatus of an underground embedded type to be disposed below a cover, the antenna apparatus including: an antenna element; and an installation base including a height adjustment mechanism that adjusts a distance from the antenna element to the cover, the installation base being a base where the antenna element is installed.

Advantageous Effects of Invention

According to the present invention, adjustment for satisfying the radio wave protection guidelines can be made for the antenna apparatus of an underground embedded type.

DESCRIPTION OF EMBODIMENTS

Figure 1:
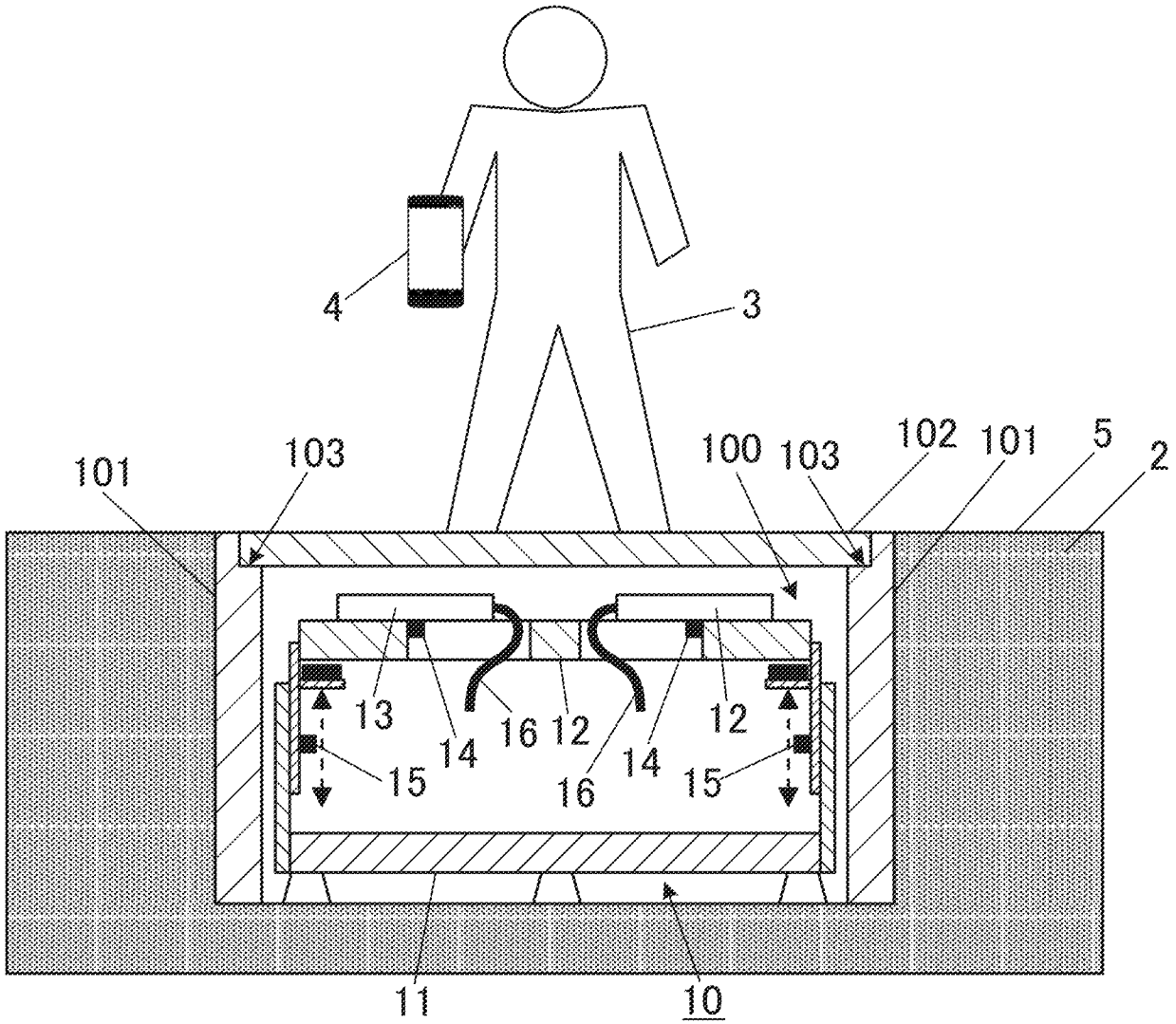
FIG. 1 is a diagram showing an outline of an antenna apparatus according to Embodiment 1.

Hereinafter, embodiments of the present invention will be described with reference to the accompanying drawings.

Embodiment 1

<Outline of Antenna Apparatus>

First, with reference to FIG. 1, an outline of antenna apparatus 10 of an underground embedded type will be described.

Antenna apparatus 10 is installed in manhole 100 formed under ground 2. On a side surface of manhole 100, side wall section 101 is provided. Manhole cover 102 is fitted to a groove formed in rim section 103 on a side of ground surface 5 of side wall section 101 and covers manhole 100.

Manhole 100 is a vertical hole formed under ground 2 so as to allow a person to come in and go out from and to the ground to manage piping of water-and-sewage pipes, gas conduits, or the like, wiring of communication cables, power distribution of electric cables, or the like. Note, however, that manhole 100 in which antenna apparatus 10 is installed is not necessarily required to have a size allowing a person to come therein and go thereout and as with the so-called handhole, may be a hole having a size which does not allow a person to come therein and go thereout. In addition, antenna apparatus 10 may be installed in manhole 100 (or a handhole) for the existing equipment and may be installed in a hole (or a dip or the like) newly formed for antenna apparatus 10. In other words, antenna apparatus 10 may be installed in any hole formed under ground 2. Therefore, manhole cover 102 is also merely one example of a cover that covers a hole formed under ground 2 and may be any cover.

As shown in FIG. 1, antenna apparatus 10 is placed in the ground inside manhole 100. Alternatively, antenna apparatus 10 may be installed so as to be suspended inside manhole 100. In this case, antenna apparatus 10 includes arm sections (not shown), and the arm sections are hooked onto rim section 103 of side wall section 101.

Antenna apparatus 10 includes supporting section 11, antenna base 12, antenna elements 13, antenna angle adjustment mechanisms 14, and antenna height adjustment mechanisms 15.

Supporting section 11 supports antenna base 12 via antenna height adjustment mechanisms 15. Antenna base 12 retains antenna elements 13 via antenna angle adjustment mechanisms 14.

Antenna elements 13 connects with a main body of a base station via connector cables 16 and transmits and receives radio waves to and from mobile terminal 4. The base station is, for example, a base station of a wireless LAN (Wi-Fi) or a base station of LTE, 5G, or the like.

Each of the antenna angle adjustment mechanisms 14 adjusts an angle of each of antenna elements 13. Note that details of antenna angle adjustment mechanisms 14 will be described later. Antenna height adjustment mechanisms 15 adjust a height (a distance up to manhole cover 102) of antenna base 12. Note that an example of adjustment by antenna height adjustment mechanisms 15 will be described later.

<Radio Wave Protection Guidelines>

Next, radio wave protection guidelines will be described.

In the radio wave protection guidelines, with respect to a location where a human body is present, for example, conditions that "an average of power densities at all measurement points shall not exceed 1,000 $\mu W/cm^2$" and that "any of the power densities at all measurement points shall not exceed 2,000 $\mu W/cm^2$" are specified.

As conventionally, when a radio base station is installed in a high place, since a distance between human body (user) 3 and antenna apparatus 10 is comparatively long, it is not so difficult to obtain a desired communication distance (or a communication area) while the conditions in the radio wave protection guidelines are satisfied. However, in a case of antenna apparatus 10 of an underground embedded type, as shown in FIG. 1, human body 3 sometimes passes immediately above antenna apparatus 10, and since a distance between human body 3 and antenna apparatus 10 is comparatively short, in order to lengthen the communication distance as long as possible while the conditions in the radio wave protection guidelines are satisfied, delicate adjustment is required.

Therefore, in the present embodiment, in order to allow the adjustment as mentioned above to be easily performed on an installation site, antenna apparatus 10 which includes antenna angle adjustment mechanisms 14 and antenna height adjustment mechanisms 15 is provided.

<Antenna Height Adjustment Mechanisms>

Next, an example of adjusting an antenna height by antenna height adjustment mechanisms 15 will be described.

For example, when each measured power density exceeds each of the conditions in the radio wave protection guidelines, a distance from antenna elements 13 to manhole cover 102 is made long by antenna height adjustment mechanisms 15 (that is, antenna elements 13 are located away from ground surface 5). This allows an electromagnetic field strength at measurement points above antenna apparatus 10 to be weakened.

On the other hand, when each measured power density sufficiently satisfies each of the conditions in the radio wave protection guidelines, the distance from antenna elements 13 to manhole cover 102 is made short by antenna height adjustment mechanisms 15 (that is, antenna elements 13 are made to approach ground surface 5). This allows the electromagnetic field strength at the measurement points above antenna apparatus 10 to be strengthened and a communication distance to be lengthened. Note that a specific configuration example of antenna height adjustment mechanisms 15 will be described in Embodiments 2 to 6.

<Antenna Angle Adjustment Mechanisms>

Next, with reference to FIG. 2A and FIG. 2B, antenna angle adjustment mechanisms 14 will be described.

Figure 2A:
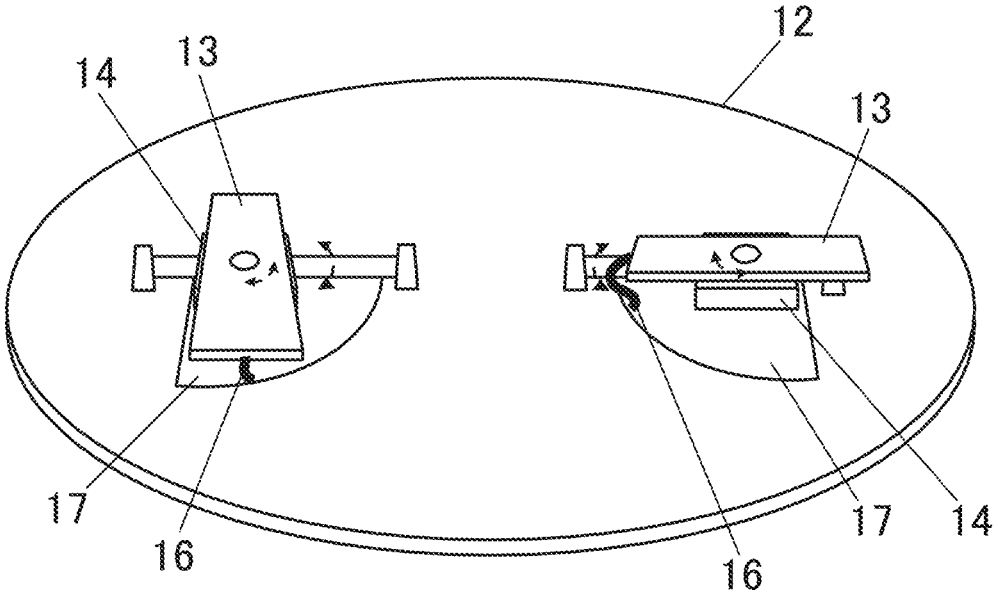
FIGS. 2A and 2B are diagrams illustrating an antenna angle adjustment mechanism according to Embodiment 1.
Figure 2B:
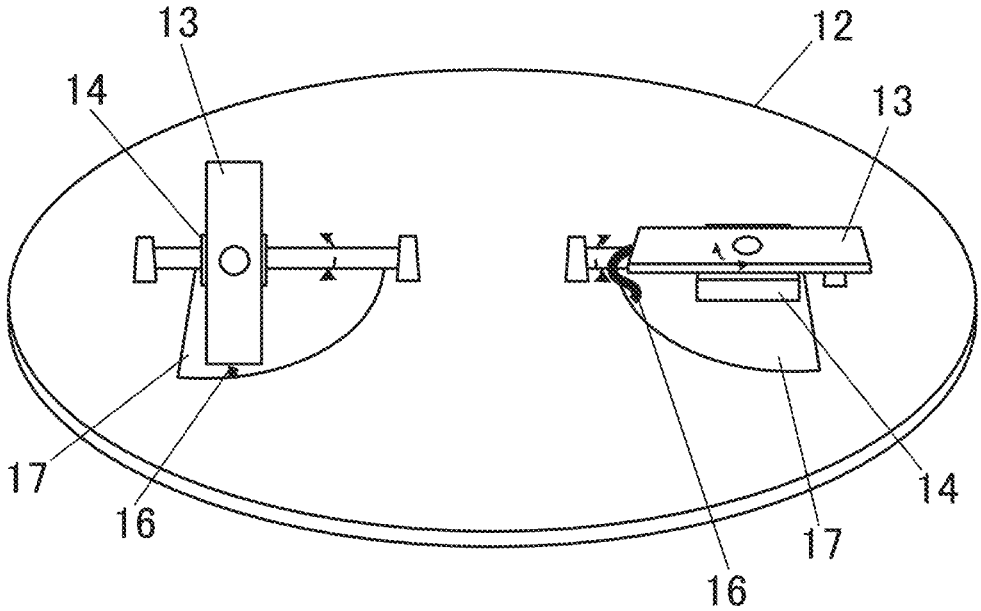

Each of antenna angle adjustment mechanisms 14 is a mechanism which is operable, as shown in FIG. 2A, to rotate each of antenna elements 13 at 90 degrees in a horizontal direction with respect to a principal surface of antenna base 12 and as shown in FIG. 2B, to rotate each of antenna elements 13 at 90 degrees in a vertical direction with respect to the principal surface of antenna base 12.

In addition, as shown in FIG. 2A and FIG. 2B, in the vicinity of lower portions of antenna angle adjustment mechanisms 14 in antenna base 12, holes 17 are formed so as to allow antenna elements 13 to rotate in the vertical direction and to allow connector cables 16 extending from antenna elements 13 to lead to below antenna base 12. A shape of each of holes 17 is, for example, a fan-shape with a central angle of 90 degrees.

Note that each of antenna elements 13 is housed in an antenna case and is thereby protected from foreign powder dust, rain water, and the like. In this case, each of antenna angle adjustment mechanisms 14 may be a mechanism which is operable to rotate the antenna case which houses each of antenna elements 13.

Next, with reference to FIG. 3 to FIG. 5, radio wave radiation patterns (a simulation result) obtained when the angles of two antenna elements (sleeve antennas) 13 installed on antenna base 12 have been adjusted will be described. Note that a plurality of radio wave radiation patterns shown in FIG. 3 to FIG. 5 are in a case in which frequencies of radio waves are 1.5 GHz, 1.8 GHz, 2 GHz, and 3.5 GHz.

Figure 3:
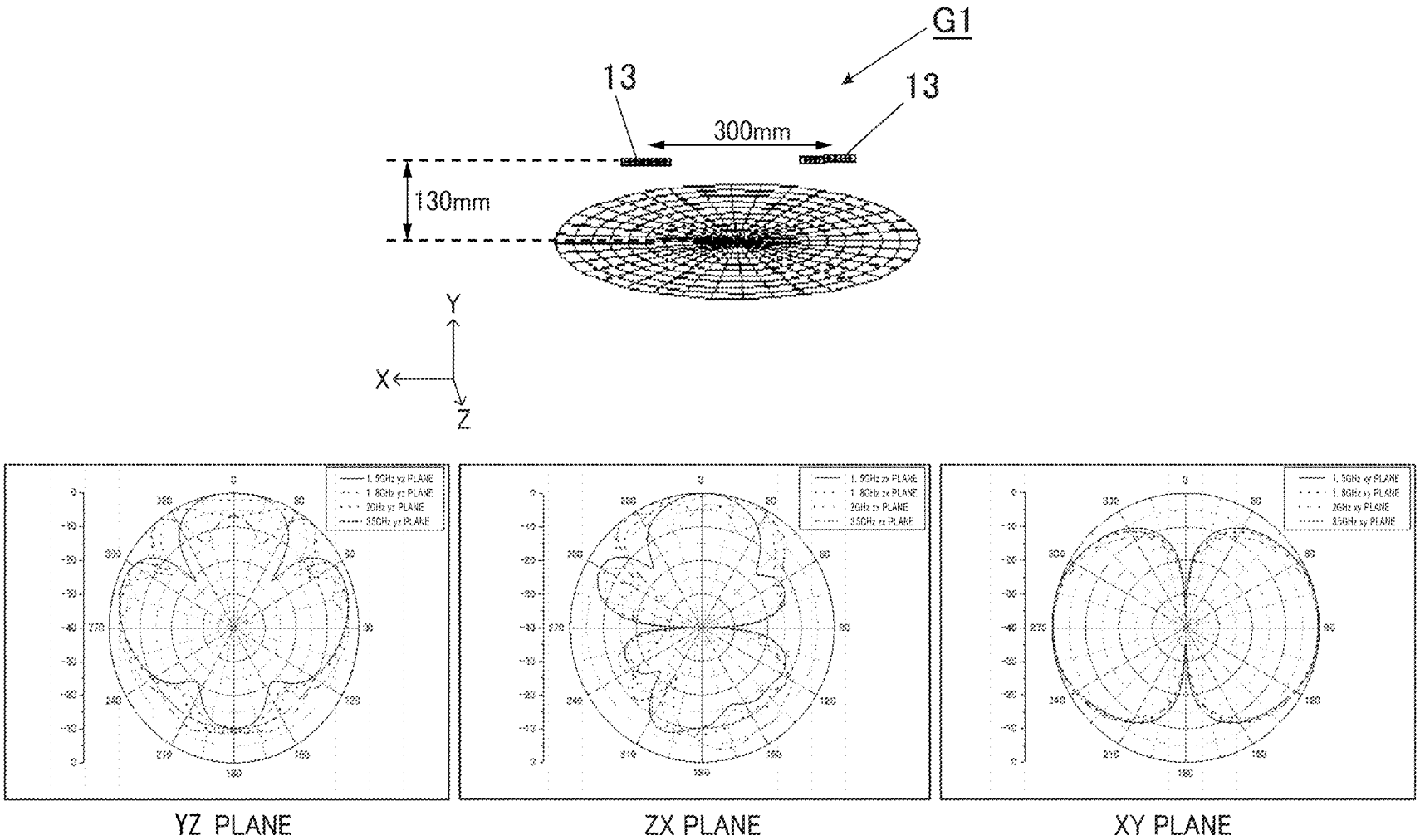
FIG. 3 is a diagram showing a simulation result of radio wave radiation patterns of two antenna elements.

FIG. 3 shows radio wave radiation patterns in a position with a distance of 130 mm in a Z axis direction away from antenna elements 13, exhibited when as indicated by disposition G1, two antenna elements 13 were separated with a distance of 300 mm from each other and angles were adjusted such that main axes of two antenna elements 13 were in parallel with an X axis.

Figure 4:
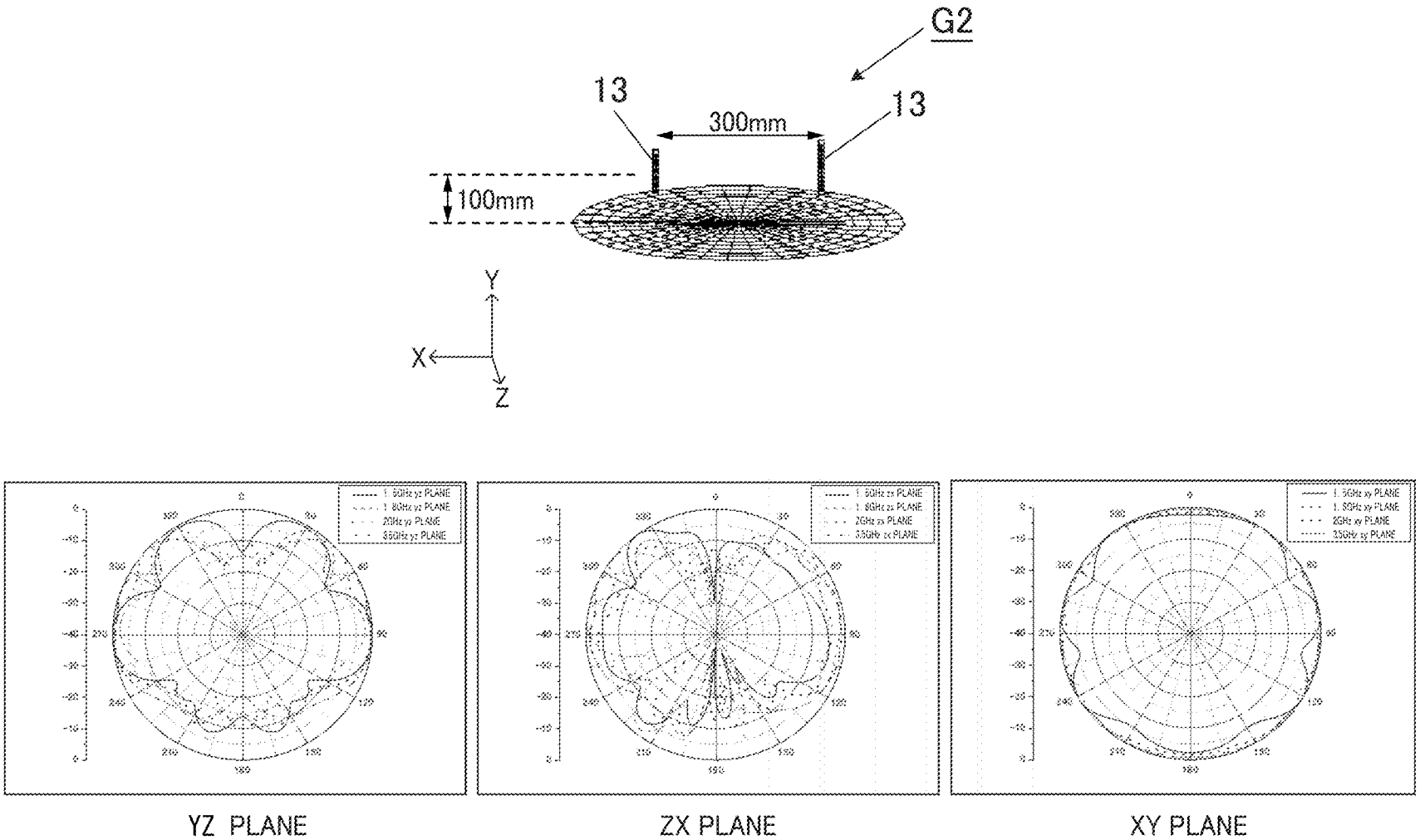
FIG. 4 is a diagram showing a simulation result of radio wave radiation patterns of the two antenna elements.

FIG. 4 shows radio wave radiation patterns in a position with a distance of 100 mm in the Z axis direction away from antenna elements 13, exhibited when as indicated by disposition G2, two antenna elements 13 were separated with the distance of 300 mm from each other and angles were adjusted such that the main axes of two antenna elements 13 were in parallel with a Z axis.

Figure 5:
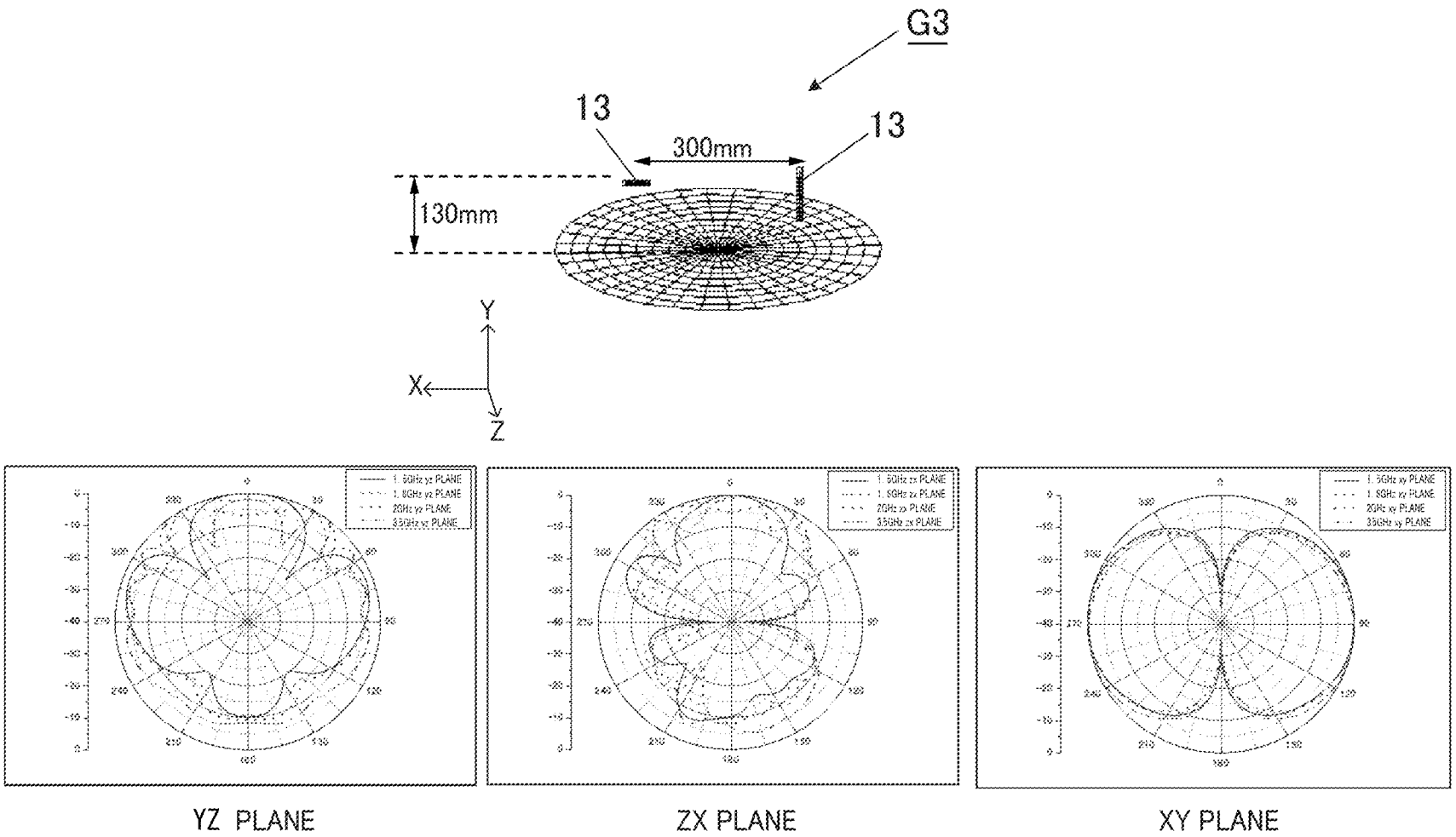
FIG. 5 is a diagram showing a simulation result of radio wave radiation patterns of the two antenna elements.

FIG. 5 shows radio wave radiation patterns in a position with the distance of 130 mm in the Z axis direction away from antenna elements 13, exhibited when as indicated by disposition G3, two antenna elements 13 were separated with the distance of 300 mm from each other and angles were adjusted such that a main axis of one of antenna elements 13 was in parallel with the X axis and a main axis of the other of antenna elements 13 was in parallel with the Z axis.

In FIG. 3 to FIG. 5, in a diagram of a YZ plane, a horizontal axis indicates a Y axis direction, a vertical axis indicates a Z axis direction. In a diagram of a ZX plane, a horizontal axis indicates an X axis direction and a vertical axis indicates a Z axis direction. In a diagram of an XY plane, a horizontal axis indicates a Y axis direction and a vertical axis indicates an X axis direction.

By referencing radio wave radiation patterns of all of the YZ planes and the ZX planes in FIG. 3 to FIG. 5, it is seen that in accordance with an increase in a distance from antenna elements 13 in the Z axis direction, an electric field strength of radio waves decreases. In addition, it is seen that even when the frequencies of radio waves are different from one another, the above-mentioned tendency is the same.

In addition, by comparing radio wave radiation patterns of the XY planes in FIG. 3 to FIG. 5, it is seen that when a wide communication area is formed evenly in the X axis direction and the Y axis direction from a center of antenna apparatus 10, it is preferable that antenna angle adjustment mechanisms 14 are adjusted such that antenna axes of two antenna elements 13 are in parallel with the Z axis.

Note, however, that the above-mentioned FIG. 3 to FIG. 5 are referenced merely to show that by changing the angles of antenna elements 13, the radio wave radiation patterns change, and the simulation result shown in FIG. 3 to FIG. 5 does not limit the invention at all.

<Summary of Embodiment 1>

As described above, in Embodiment 1, antenna apparatus 10 of an underground embedded type includes antenna angle adjustment mechanisms 14 which adjust the angles of antenna elements 13 and antenna height adjustment mechanisms 15 which adjust the height of antenna base 12. Thus, a worker can easily perform, on the installation site of antenna apparatus 10, the adjustment to lengthen the communication distance as long as possible while the conditions in the radio wave protection guidelines are satisfied.

Embodiment 2

<Configuration of Antenna Apparatus>

Figure 6:
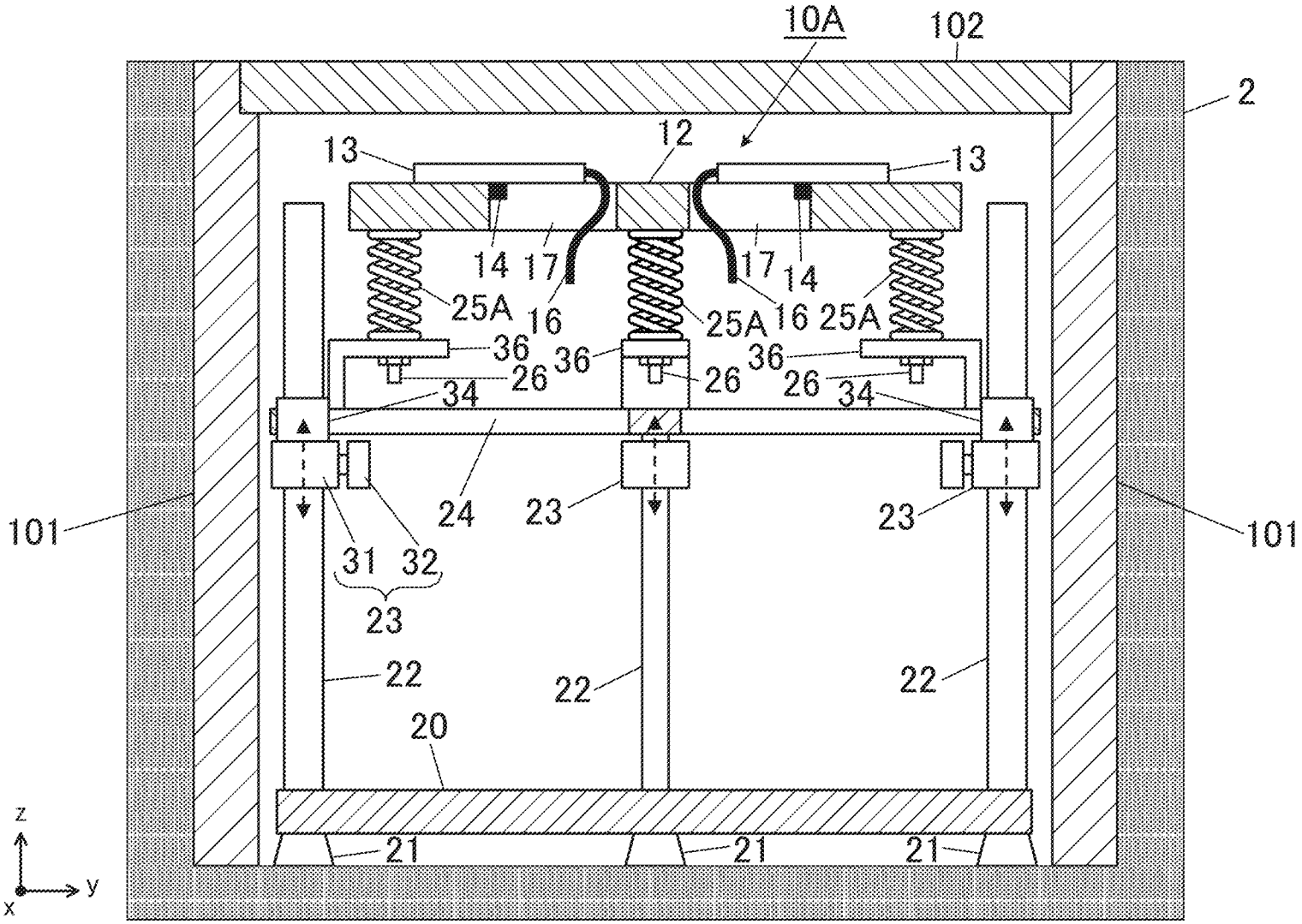
FIG. 6 is a sectional side view of an antenna apparatus according to Embodiment 2.
Figure 7:
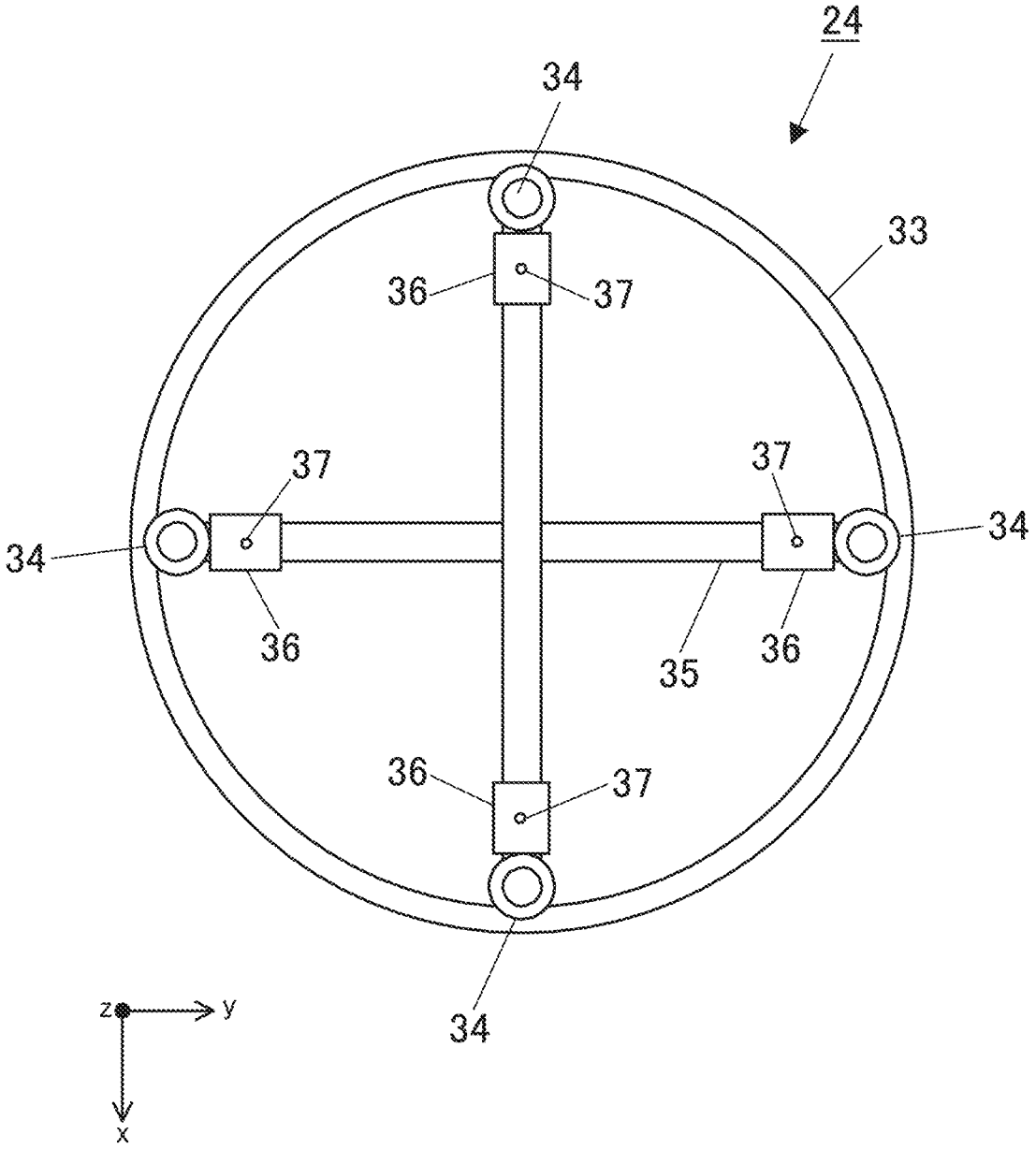
FIG. 7 is a plan view of an intermediate member of the antenna apparatus according to Embodiment 2.

Next, with reference to FIG. 6 and FIG. 7, a configuration of antenna apparatus 10A according to Embodiment 2 will be described. FIG. 6 is a sectional side view of antenna apparatus 10A. FIG. 7 is a plan view of intermediate member 24 which is a component of antenna apparatus 10A, viewed from above. Note that components in common with those in Embodiment 1 are denoted by the same reference signs, and the description for the components in common therewith will be omitted.

As with antenna apparatus 10, antenna apparatus 10A includes antenna base 12, antenna elements 13, and antenna angle adjustment mechanisms 14. In addition, antenna apparatus 10A further includes pedestal 20, leg sections 21, supporting columns 22, height adjusters 23, intermediate member 24, and buffer sections 25A.

Pedestal 20, leg sections 21, and supporting columns 22 in antenna apparatus 10A correspond to one example of supporting section 11 of antenna apparatus 10. Height adjusters 23 and intermediate member 24 in antenna apparatus 10A correspond to one example of antenna height adjustment mechanisms 15. In addition, height adjusters 23 may be called a positioning section which determines a position where antenna base 12 is attached.

Pedestal 20 is provided with a plurality of leg sections 21 on a lower surface thereof and by grounding leg sections 21 on a ground surface inside manhole 100, is disposed horizontally with respect to the ground surface.

Supporting columns 22 are fixed vertically with respect to pedestal 20 and extend upward. FIG. 6 shows an example in which the number of supporting columns 22 is four. Note, however, that the present embodiment is not limited thereto, and the number thereof may be any number as long as the number thereof is two or more.

Height adjusters 23 are tools which can be attached in any positions (at heights) of supporting columns 22. Each of height adjusters 23 is constituted of cylindrical section 31 and fixture 32. An inner diameter of cylindrical section 31 is larger than an outer diameter of each of supporting columns 22. Each of supporting columns 22 is inserted into cylindrical section 31. Fixture 32 is, for example, a screw. By tightening fixture 32 (the screw), cylindrical section 31 is fixed to each of supporting columns 22. By loosening fixture 32 (the screw), cylindrical section 31 becomes movable in upward and downward directions along supporting columns 22. Note, however, that fixture 32 is not limited to the screw type, and may be a push-type, a slide-type, or the like. Note that when fixture 32 has a structure projecting in a vertical direction with respect to an axis of each of supporting columns 22, in order to cause no hindrance when antenna apparatus 10A is installed in manhole 100, it is preferable that fixture 32 is disposed so as to project in a direction toward a center of manhole 100 (that is, inwardly).

As shown in FIG. 7, intermediate member 24 is constituted of circular ring section 33, cylindrical sections 34, reinforcing plates 35, and brackets 36. Circular ring section 33 is of a circular ring shape, and a diameter thereof is smaller than a diameter of manhole 100 and larger than a diameter of antenna base 12. An inner diameter of each of cylindrical sections 34 is larger than an outer diameter of each of supporting columns 22. Each of cylindrical sections 34 is welded to an inside of circular ring section 33. The number of cylindrical sections 34 is the same as the number of supporting columns 22. Reinforcing plates 35 are welded such that the two plates are crossed at a center point of circular ring section 33. Further, reinforcing plates 35 are welded to cylindrical sections 34 in edge portions thereof. Brackets 36 are welded to reinforcing plates 35 in the vicinity of cylindrical sections 34. In addition, in brackets 36, attaching holes 37 are formed.

As shown in FIG. 6, intermediate member 24 is disposed above height adjusters 23. In other words, each of supporting columns 22 is inserted into each of cylindrical sections 34 of intermediate member 24. Note that intermediate member 24 is reinforced by reinforcing plates 35 so as not to be a mere flat plate because rain water and the like is prevented from accumulating in intermediate member 24.

Each of buffer sections 25A is fixed by a screw or the like to a portion of each of attaching holes 37 of brackets 36 of intermediate member 24. In FIG. 6, an example in which the number of buffer sections 25A is four is shown. Note, however, that the present embodiment is not limited thereto, and the number thereof may be any number as long as the number thereof is three or more. In addition, in FIG. 6, a case in which each of buffer sections 25A is a spring is shown. However, the present embodiment is not limited thereto, and each of buffer sections 25A may be rubber, a cushion, or the like.

Four rods 26 are welded to a seating surface of antenna base 12. In addition, with buffer sections 25A placed on brackets 36, rods 26 are inserted into buffer sections 25A and attaching holes 37. Nuts are attached from tip ends of rods 26 as stoppers. Thus, antenna base 12 is fixed to intermediate member 24 and is positioned in a height direction by a biasing force of each of buffer sections 25A.

By employing the configuration of antenna apparatus 10A, positions of height adjusters 23 are changed, thereby allowing positions (heights) of intermediate member 24, buffer sections 25A, and antenna base 12 to be changed.

Specifically, by moving height adjusters 23 downward, the position of antenna base 12 can be moved downward (in a direction away from manhole cover 102). Conversely, by moving height adjusters 23 upward, the position of antenna base 12 can be moved upward (in a direction approaching manhole cover 102). Thus, a worker can adjust an electromagnetic field strength of radio waves on an installation site of antenna apparatus 10A so as to satisfy the conditions in the radio wave protection guidelines.

In addition, by placing antenna base 12 on buffer sections 25A, vibration which is received by pedestal 20, supporting columns 22, intermediate member 24, and the like from an outside can be inhibited from directly being transmitted to antenna base 12. Thus, displacement of the positions (for example, the angles) of antenna elements 13 installed on antenna base 12, which is caused by the vibration from the outside, slipping-off of connector cables 16 of antenna elements 13, and the like can be inhibited.

Note that height adjusters 23 may be configured to be fixed only in some predetermined positions (at heights). For example, height adjusters 23 may be configured such that a hole is formed in a predetermined position of each of supporting columns 22, a hole is formed on a side surface of cylindrical section 31, and fixture 32 (a pin) is inserted into the hole of cylindrical section 31 and the hole of each of supporting columns 22.

<Summary of Embodiment 2>

As described above, in Embodiment 2, the configuration of antenna apparatus 10A of an underground embedded type is adopted in which intermediate member 24 is placed above height adjusters 23 provided for supporting columns 22 and antenna base 12 is placed above intermediate member 24. Thus, since a worker can easily change attaching positions of height adjusters 23 on the installation site of antenna apparatus 10A, a height of antenna base 12 can be easily adjusted.

Embodiment 3

<Configuration of Antenna Apparatus>

Figure 8:
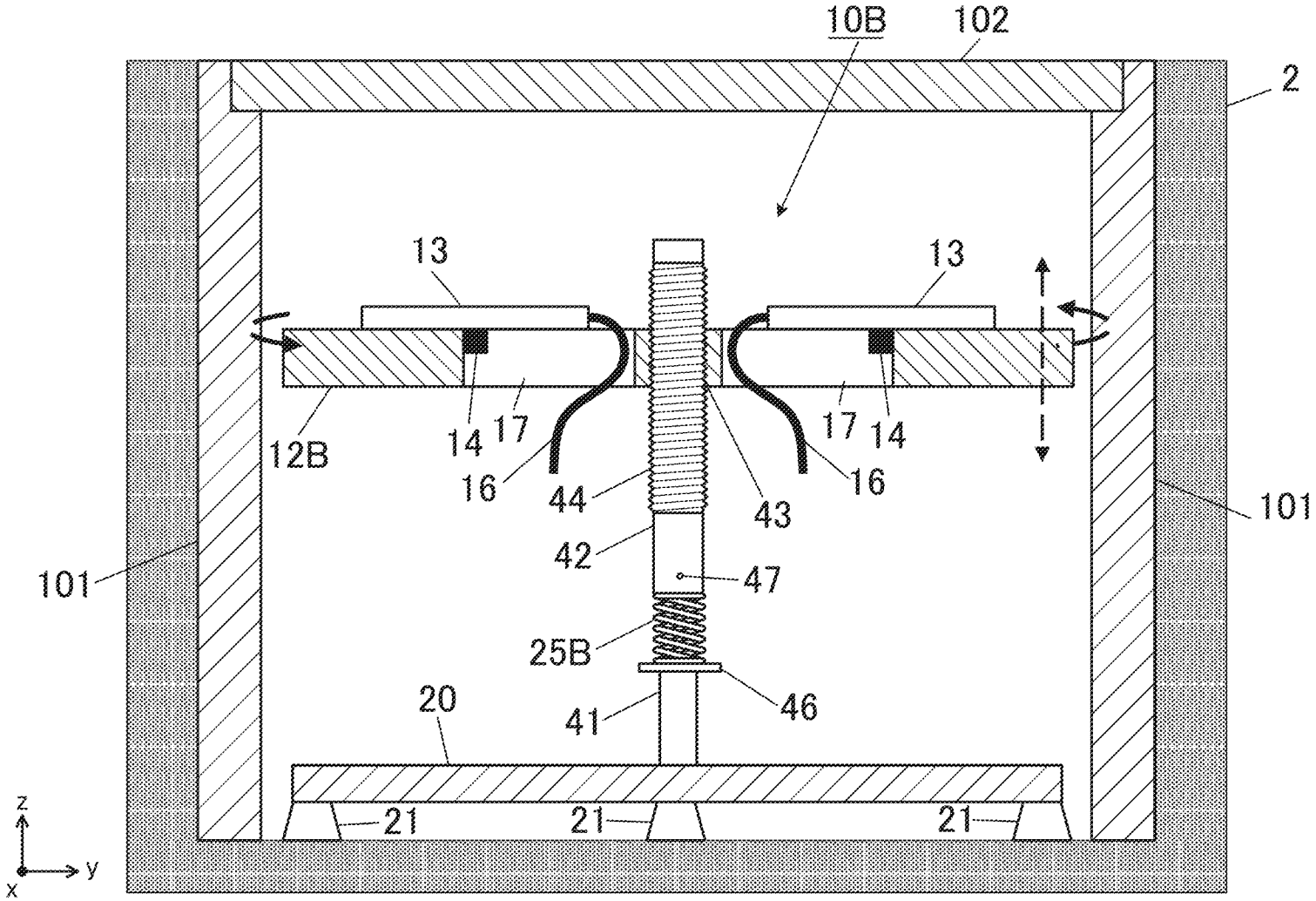
FIG. 8 is a sectional side view of an antenna apparatus according to Embodiment 3.

Next, with reference to FIG. 8, a configuration of antenna apparatus 10B according to Embodiment 3 will be described. FIG. 8 is a sectional side view of antenna apparatus 10B. Note that components of antenna apparatus 10B in FIG. 8 which are in common with those in antenna apparatus 10A shown in FIG. 6 are denoted by the same reference signs, and the description for the components in common therewith will be omitted.

As with antenna apparatus 10A, antenna apparatus 10B includes antenna elements 13, antenna angle adjustment mechanisms 14, pedestal 20, and leg sections 21. In addition, antenna apparatus 10B includes antenna base 12B and buffer section 25B. Antenna base 12B is different from antenna base 12 of antenna apparatus 10A in that screw hole 43 is formed in a central portion thereof. Buffer section 25B is different from each of buffer sections 25A of antenna apparatus 10A in that buffer section 25B is a spring having a through hole formed therein. In addition, antenna apparatus 10B includes first supporting column 41 and second supporting column 42.

Pedestal 20, leg sections 21, first supporting column 41, and second supporting column 42 in antenna apparatus 10B correspond to one example of supporting section 11 of antenna apparatus 10. Screw hole 43 formed in a central portion of antenna base 12B and screw groove 44 threaded on at least one portion of second supporting column 42 in antenna apparatus 10B correspond to one example of antenna height adjustment mechanisms 15.

First supporting column 41 is fixed vertically with respect to a principal surface of pedestal 20 in a central portion of an upper surface of pedestal 20 and extends upward. In addition, first supporting column 41 is provided with stopper 46 having a surface vertical with respect to a main axis of first supporting column 41.

Buffer section 25B has the through hole formed in a central portion thereof. First supporting column 41 is inserted into the through hole of buffer section 25B and a lower end of buffer section 25B is placed on stopper 46.

Second supporting column 42 is of a cylindrical shape allowing first supporting column 41 to be inserted thereinto, and first supporting column 41 is inserted into the cylinder. Second supporting column 42 is supported to first supporting column 41, with a lower end of second supporting column 42 contacting an upper end of buffer section 25B.

In addition, in order to avoid rotation of second supporting column 42 with respect to first supporting column 41, first supporting column 41 and second supporting column 42 are provided with rotation preventing mechanisms. As the rotation preventing mechanisms, for example, a configuration is adopted in which pin 47 attached on second supporting column 42 is fitted into a cutout (not shown) formed in first supporting column 41.

By employing the configuration of antenna apparatus 10B, since screw hole 43 of antenna base 12B and screw groove 44 of second supporting column 42 are screwed with each other, by rotating antenna base 12B, a height of antenna base 12B can be changed.

For example, by rotating antenna base 12B clockwise, a position of antenna base 12B can be moved downward (in a direction away from manhole cover 102)). Conversely, by rotating antenna base 12B counterclockwise, the position of antenna base 12B can be moved upward (in a direction approaching manhole cover 102). Thus, on an installation site of antenna apparatus 10B, an electromagnetic field strength of radio waves can be adjusted so as to satisfy the conditions in the radio wave protection guidelines.

In addition, by providing buffer section 25B between first supporting column 41 and second supporting column 42, vibration which is received by pedestal 20 and first supporting column 41 from an outside can be inhibited from directly being transmitted to antenna base 12B. Thus, displacement of positions (for example, angles) of antenna elements 13 installed on antenna base 12B, which is caused by the vibration from the outside, slipping-off of connector cables 16 of antenna elements 13, and the like can be inhibited.

In addition, second supporting column 42 may be provided with a scale (not shown) in a height direction. Thus, even without separately using a surveying tool, the height of antenna base 12B can be visually checked. In other words, on the installation site thereof, adjustment of an electromagnetic field strength of radio waves can be further facilitated.

Note that in the present embodiment, instead of screw hole 43 of antenna base 12B and screw groove 44 of second supporting column 42 as antenna height adjustment mechanisms 15, other configuration may be adopted. For example, height adjuster 23 illustrated in FIG. 6 is attached to second supporting column 42. In the central portion of antenna base 12B, instead of the screw hole, a through hole is formed, second supporting column 42 is inserted into the through hole, and antenna base 12 is place above height adjuster 23. Also by adopting this configuration, by adjusting a position of attaching height adjuster 23, a height of antenna base 12B can be adjusted.

<Summary of Embodiment 3>

As described above, in Embodiment 3, the configuration of antenna apparatus 10B of an underground embedded type is adopted in which screw hole 43 of antenna base 12B and screw groove 44 of second supporting column 42 are screwed with each other. Thus, a worker rotates antenna base 12B on the installation site of antenna apparatus 10B, thereby allowing the height of antenna base 12B to be easily adjusted.

Embodiment 4

<Configuration of Antenna Apparatus>

Figure 9:
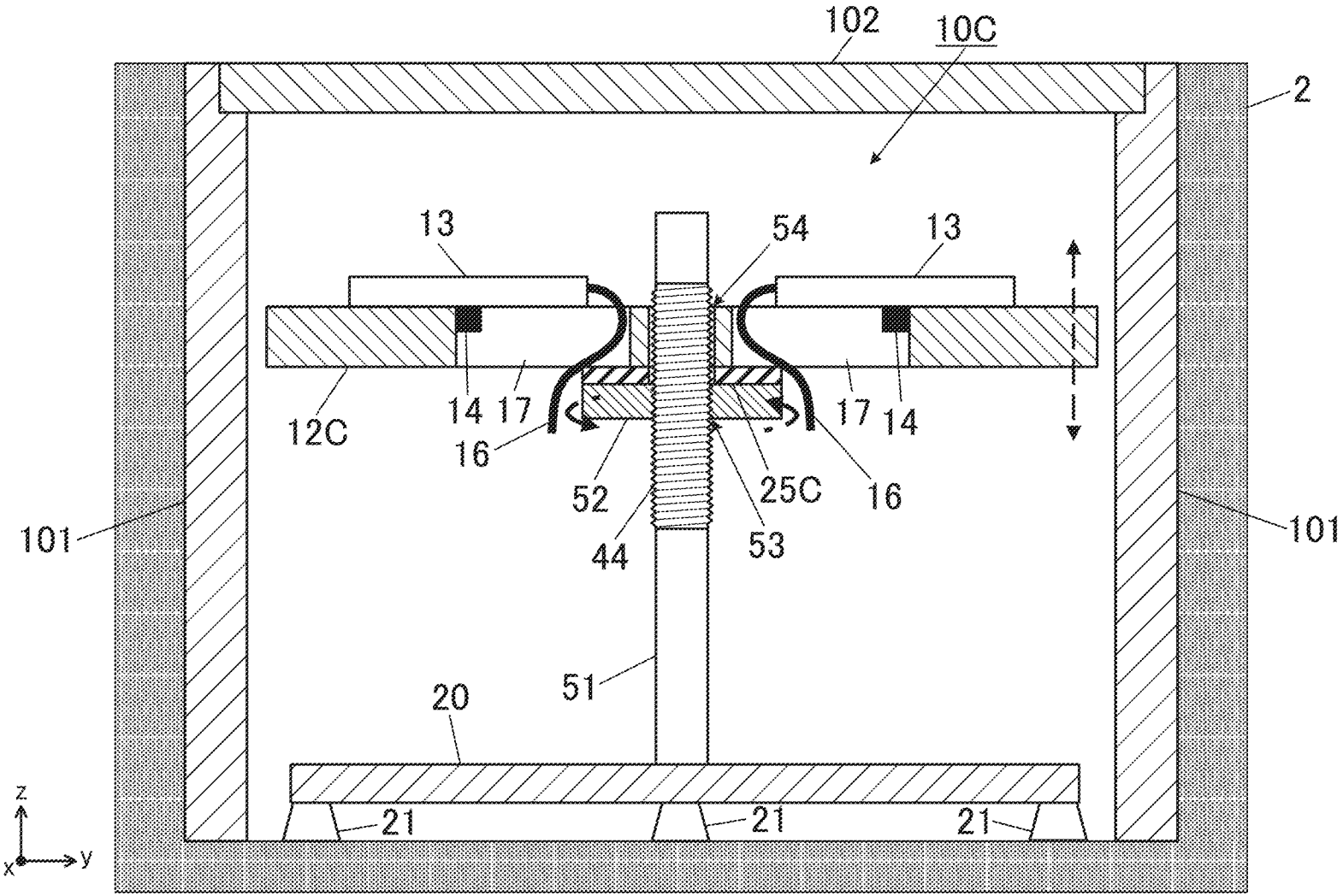
FIG. 9 is a sectional side view of an antenna apparatus according to Embodiment 4.

Next, with reference to FIG. 9, a configuration of antenna apparatus 10C according to Embodiment 4 will be described. FIG. 9 is a sectional side view of antenna apparatus 10C. Note that components of antenna apparatus 10C in FIG. 9 which are in common with those in antenna apparatus 10B shown in FIG. 8 are denoted by the same reference signs, and the description for the components in common therewith will be omitted.

As with antenna apparatus 10B, antenna apparatus 10C includes antenna elements 13, antenna angle adjustment mechanisms 14, pedestal 20, and leg sections 21. In addition, antenna apparatus 10C includes antenna base 12C and buffer section 25C. Antenna base 12C is different from antenna base 12B of antenna apparatus 10B in that through hole 54 is formed in a central portion thereof, instead of screw hole 43 and in that buffer section 25C is rubber or a cushion. In addition, antenna apparatus 10C includes supporting column 51 and intermediate member 52.

Pedestal 20, leg sections 21, and supporting column 51 in antenna apparatus 10C correspond to one example of supporting section 11 of antenna apparatus 10. Intermediate member 52, screw hole 53 formed in the central portion of intermediate member 52, and screw groove 44 threaded on at least one portion of supporting column 51 in antenna apparatus 10C correspond to one example of antenna height adjustment mechanisms 15.

Supporting column 51 is fixed vertically with respect to pedestal 20 in a central portion of an upper surface of pedestal 20 and extends upward.

Screw hole 53 of intermediate member 52 is screwed with screw groove 44 of supporting column 51. In addition, on an upper surface of intermediate member 52, buffer section 25C is provided. Note that although in FIG. 9, a case in which intermediate member 52 is smaller than antenna base 12C is shown, the present embodiment is not limited thereto, and a size of intermediate member 52 may be the same as a size of antenna base 12C or be the size or more of antenna base 12C.

Supporting column 51 is inserted into through hole 54 in the central portion of antenna base 12C and antenna base 12C is placed above intermediate member 52.

By employing the configuration of antenna apparatus 10C, since screw groove 44 of supporting column 51 and screw hole 53 of intermediate member 52 are screwed with each other, by rotating intermediate member 52, heights of intermediate member 52 and antenna base 12C placed above intermediate member 52 can be changed.

For example, by rotating intermediate member 52 clockwise, a position of antenna base 12C can be moved downward (in a direction away from manhole cover 102). Conversely, by rotating intermediate member 52 counterclockwise, the position of antenna base 12 can be moved upward (in a direction approaching manhole cover 102). Thus, on an installation site of antenna apparatus 10C, an electromagnetic field strength of radio waves can be adjusted so as to satisfy the conditions in the radio wave protection guidelines.

In addition, by providing buffer section 25C on the upper surface of intermediate member 52, vibration which is received by leg sections 21, supporting column 51, and intermediate member 52 from an outside can be inhibited from directly being transmitted to antenna base 12C. Thus, displacement of positions (for example, angles) of antenna elements 13 installed on antenna base 12C, which is caused by the vibration from the outside, slipping-off of connector cables 16 of antenna elements 13, and the like can be inhibited.

Note that in order for antenna base 12C not to freely rotate around supporting column 51 due to the vibration or the like, a rotation preventing mechanism (not shown) is provided. As the rotation preventing mechanism, for example, a configuration is adopted in which a hole (not shown) is formed in a portion of antenna base 12C contacting intermediate member 52, intermediate member 52 has a projecting section (not shown) extending upward, and the projecting section is inserted into the hole of antenna base 12C. Note that antenna base 12 may be provided with a plurality of holes formed at equal intervals on a concentric circle. Thus, antenna base 12C can be fixed in a position with a desired rotational angle or angles.

In addition, supporting column 51 may be provided with a scale (not shown) in a height direction. Thus, even without separately using a surveying tool, the height of antenna base 12C can be visually checked. In other words, on the installation site thereof, adjustment of an electromagnetic field strength of radio waves can be further facilitated.

<Summary of Embodiment 4>

As described above, in Embodiment 4, the configuration of antenna apparatus 10C of an underground embedded type is adopted in which screw hole 53 of intermediate member 52 and screw groove 44 of supporting column 51 are screwed with each other and antenna base 12C is placed above intermediate member 52. Thus, on a work site of antenna apparatus 10C, a worker rotates intermediate member 52, thereby determines a height, and thereafter, places antenna base 12C on intermediate member 52, thereby allowing the height of antenna base 12C to be easily adjusted.

Embodiment 5

<Configuration of Antenna Apparatus>

Figure 10:
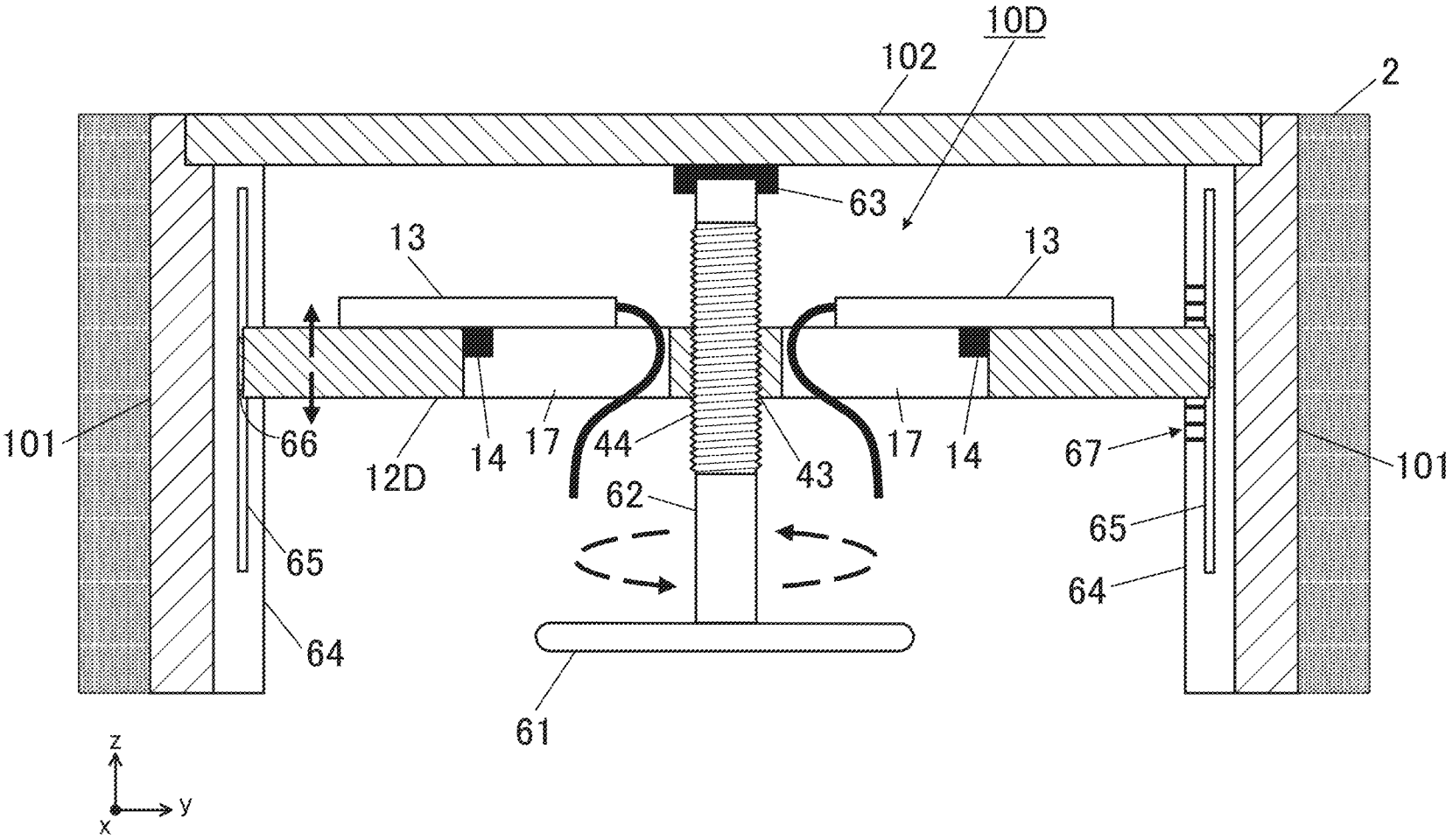
FIG. 10 is a sectional side view of an antenna apparatus according to Embodiment 5.

Next, with reference to FIG. 10, a configuration of antenna apparatus 10D according to Embodiment 5 will be described. FIG. 10 is a sectional side view of antenna apparatus 10D. Note that components of antenna apparatus 10D in FIG. 10 which are in common with those in antenna apparatus 10B shown in FIG. 8 are denoted by the same reference signs, and the description for the components in common therewith will be omitted.

As with antenna apparatus 10B, antenna apparatus 10D includes antenna elements 13 and antenna angle adjustment mechanisms 14. In addition, antenna apparatus 10D includes antenna base 12D, handle section 61, shaft section 62, bearing section 63, and guide sections 64. Antenna base 12D is different from antenna base 12B in that on a side surface thereof, a projecting section 66 is provided.

Shaft section 62 in antenna apparatus 10D corresponds to one example of supporting section 11 of antenna apparatus 10. Screw hole 43 of antenna base 12D and screw groove 44 threaded on at least one portion of shaft section 62 in antenna apparatus 10D correspond to one example of antenna height adjustment mechanisms 15.

Handle section 61 is horizontally disposed below manhole cover 102 so as to face manhole cover 102.

One end of shaft section 62 is welded to a central portion of handle section 61 vertically with respect to handle section 61, and shaft section 62 extends upward.

Bearing section 63 is provided in a central portion of a lower surface of manhole cover 102 and receives rotatably the other end of shaft section 62 (that is, an end which is not welded to handle section 61).

Screw hole 43 of antenna base 12D is screwed with screw groove 44 of shaft section 62.

In guide sections 64, slide grooves 65 are formed in a longitudinal direction. Guide sections 64 are fixed to side wall section 101 such that slide grooves 65 are in parallel with shaft section 62. Projecting section 66 of antenna base 12D is inserted to slide grooves 65. Thus, rotation of antenna base 12D is prevented. Accordingly, slide grooves 65 and projecting section 66 of antenna base 12D correspond to one example of rotation preventing mechanisms.

By employing the configuration of antenna apparatus 10D, since screw groove 44 of shaft section 62 and screw hole 43 of antenna base 12D are screwed with each other, by rotating handle section 61 and axially rotating shaft section 62, a height of antenna base 12D can be changed.

For example, by rotating handle section 61 clockwise, a position of antenna base 12D can be moved upward (in a direction approaching manhole cover 102). Conversely, by rotating handle section 61 counterclockwise, the position of antenna base 12D can be moved downward (in a direction away from manhole cover 102). At this time, since projecting section 66 inserted into slide grooves 65 is capable of preventing the rotation of antenna base 12D, antenna base 12D moves in upward and downward directions without rotating.

In addition, guide sections 64 may be provided with scale 67 in a height direction. Thus, even without separately using a surveying tool, the height of antenna base 12D can be visually checked. In other words, on an installation site thereof, adjustment of an electromagnetic field strength of radio waves can be further facilitated.

<Summary of Embodiment 5>

As described above, in Embodiment 5, the configuration of antenna apparatus 10D of an underground embedded type is adopted in which screw hole 43 of antenna base 12D and screw groove 44 of shaft section 62 are screwed with each other and handle section 61 is welded to the one end of shaft section 62. Thus, on the installation site of antenna apparatus 10D, a worker rotates handle section 61 and can thereby easily adjust the height of antenna base 12D.

Embodiment 6

<Configuration of Antenna Apparatus>

Figure 11:
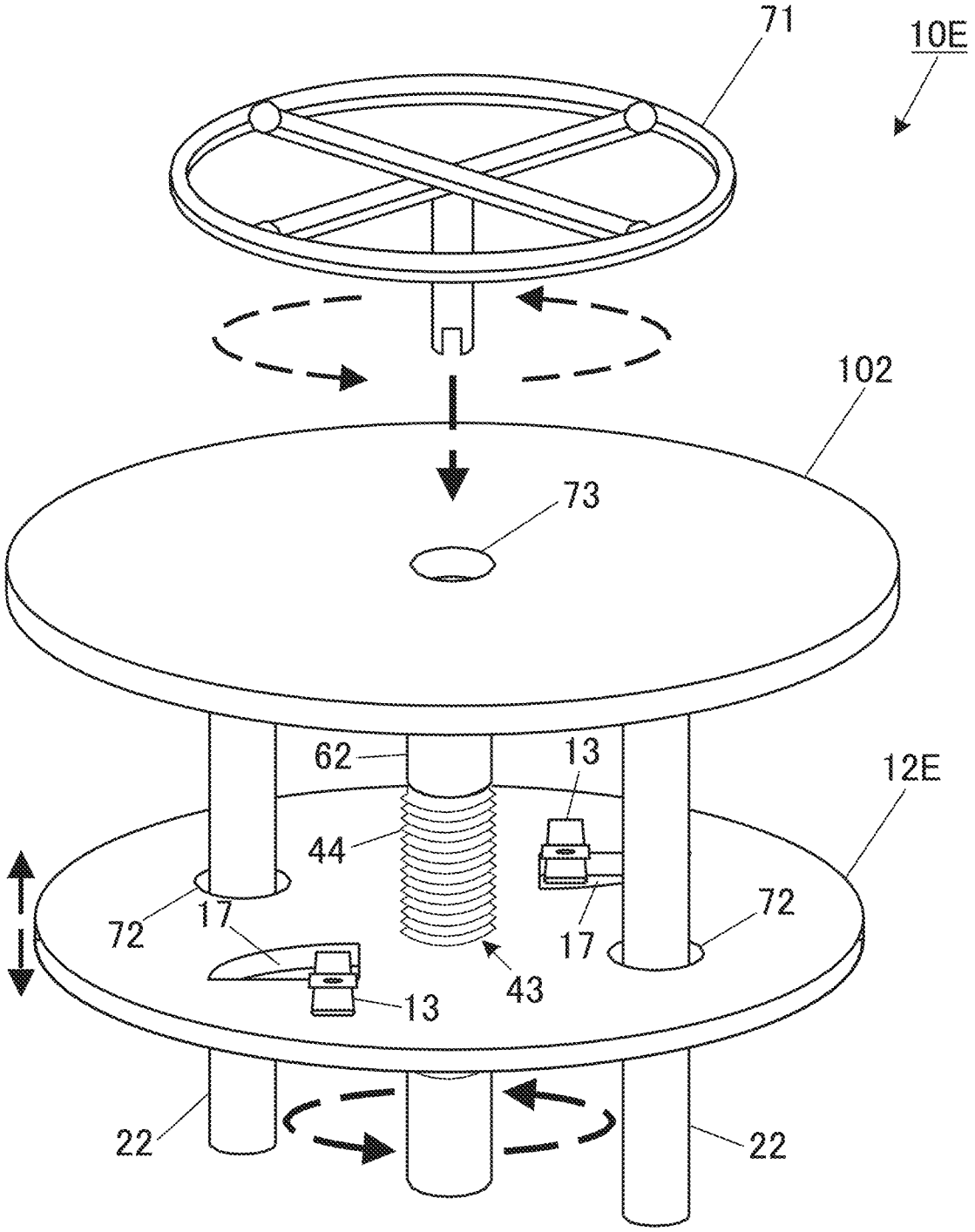
FIG. 11 is a perspective view of an antenna apparatus according to Embodiment 6.

Next, with reference to FIG. 11, a configuration of antenna apparatus 10E according to Embodiment 6 will be described. FIG. 11 is a perspective view of antenna apparatus 10E. Note that components of antenna apparatus 10E which are in common with those in antenna apparatus 10D shown in FIG. 10 are denoted by the same reference signs, and the description for the components in common therewith will be omitted.

As with antenna apparatus 10D, antenna apparatus 10E includes antenna elements 13, antenna angle adjustment mechanisms 14, and shaft section 62. In addition, antenna apparatus 10E includes antenna base 12E, supporting columns 22, handle section 71, and manhole cover 102. Antenna base 12E is different from antenna base 12B shown in FIG. 8 in that through holes 72 are formed in portions other than a central portion thereof. An inner diameter of each of through holes 72 is larger than an outer diameter of each of supporting columns 22.

Supporting columns 22 and shaft section 62 in antenna apparatus 10E correspond to one example of supporting section 11 of antenna apparatus 10. Screw hole 43 of antenna base 12E and screw groove 44 of shaft section 62 in antenna apparatus 10E correspond to one example of antenna height adjustment mechanisms 15.

Supporting columns 22 are fixed vertically with respect to manhole cover 102 in the portions other than the central portion of manhole cover 102 and extend downward. FIG. 11 shows an example in which the number of supporting columns 22 is two. Note, however, that the present embodiment is not limited thereto and the number of supporting columns 22 may be one and may be three or more.

Shaft section 62 is provided vertically with respect to manhole cover 102 in the central portion of manhole cover 102 and extends downward. An upper end of shaft section 62 is received by a bearing section (not shown) of manhole cover 102 and shaft section 62 is axially rotatable.

Screw hole 43 of antenna base 12E is screwed with screw groove 44 of shaft section 62. In addition, each of supporting columns 22 is inserted into each of through holes 72 of antenna base 12E.

Handle section 71 can be coupled to shaft section 62. Handle section 71 is coupled to shaft section 62 and handle section 71 is rotated, whereby shaft section 62 is axially rotated.

In the central portion of manhole cover 102, through hole 73 for coupling handle section 71 to shaft section 62 from an outside is formed.

By employing the configuration of antenna apparatus 10E, since screw groove 44 of shaft section 62 and screw hole 43 of antenna base 12E are screwed with each other, by coupling handle section 71 to shaft section 62 via through hole 73 of manhole cover 102 and rotating handle section 71, a height of antenna base 12E can be changed. In other words, even without opening manhole cover 102, the height of antenna base 12E can be adjusted.

For example, by rotating handle section 71 clockwise and rotating shaft section 62, a position of antenna base 12E can be moved upward (in a direction approaching manhole cover 102). Conversely, by rotating handle section 71 counterclockwise and rotating shaft section 62, the position of antenna base 12E can be moved downward (in a direction away from manhole cover 102).

At this time, since supporting columns 22 inserted into through holes 72 of antenna base 12E are capable of preventing rotation of antenna base 12E, antenna base 12E moves in upward and downward directions without rotating. Accordingly, through holes 72 of antenna base 12 and supporting columns 22 inserted into through holes 72 correspond to one example of rotation preventing mechanisms.

Note that shaft section 62 or supporting columns 22 may be provided with a scale (not shown) in a height direction. Thus, even without separately using a surveying tool, the height of antenna base 12E can be visually checked. In other words, adjustment of an electromagnetic field strength of radio waves on an installation site thereof can be further facilitated.

<Summary of Embodiment 6>

As described above, in Embodiment 6, the configuration of antenna apparatus 10E of an underground embedded type is adopted in which screw hole 43 of antenna base 12E and screw groove 44 of shaft section 62 are screwed with each other and handle section 71 can be coupled to shaft section 62 via through hole 73 of manhole cover 102. On the installation site of antenna apparatus 10E, by coupling handle section 71 to shaft section 62 via through hole 73 of manhole cover 102 and rotating handle section 71, a worker can easily adjust the height of antenna base 12E without opening manhole cover 102.

Embodiment 7

<Configuration of Antenna Apparatus>

Figure 12:
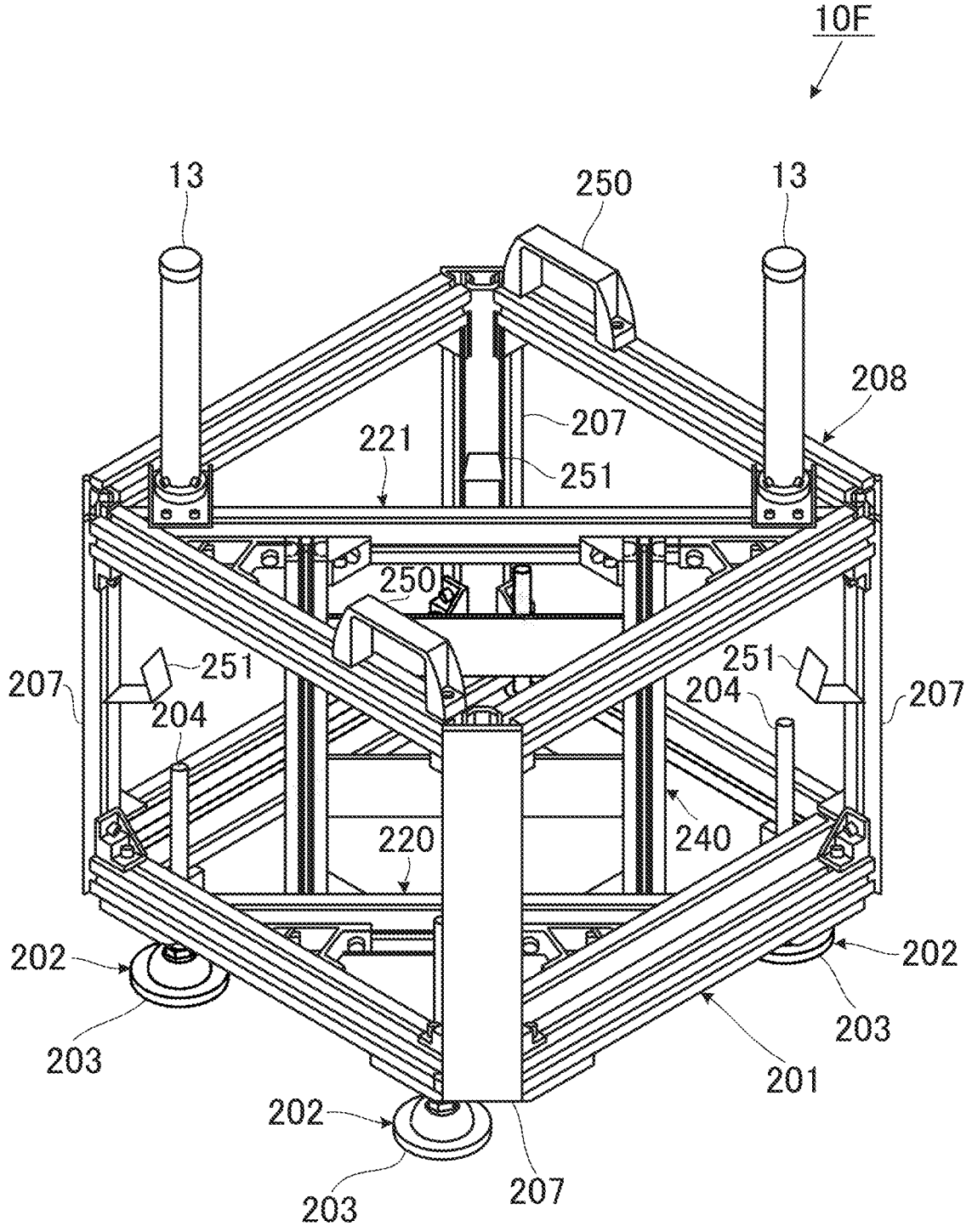
FIG. 12 is a perspective view of an antenna apparatus according to Embodiment 7.
Figure 13:
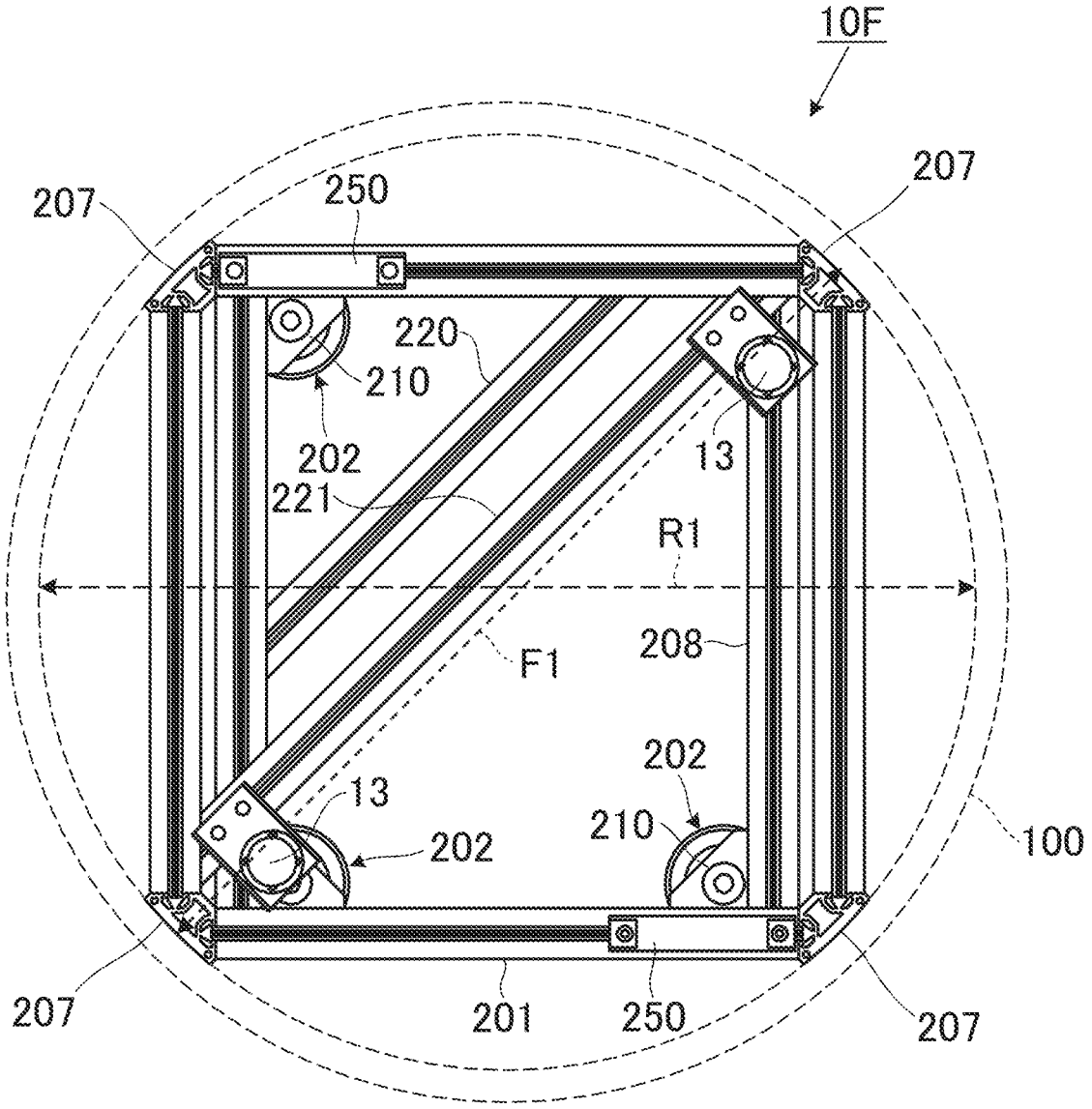
FIG. 13 is a plan view of the antenna apparatus according to Embodiment 7.
Figure 14:
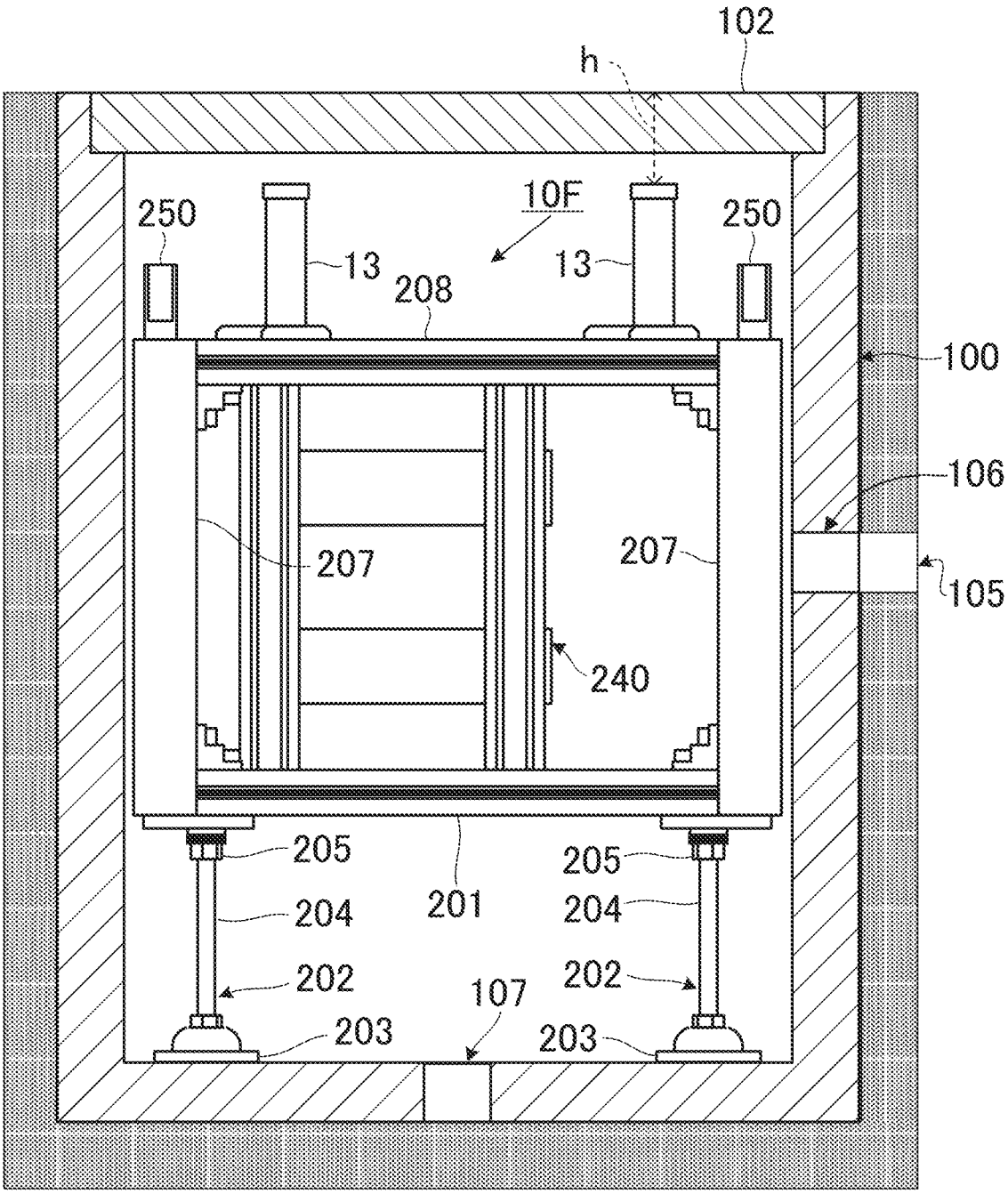
FIG. 14 is a side view of the antenna apparatus according to Embodiment 7.

Next, with reference to FIG. 12 to FIG. 14, a configuration of antenna apparatus 10F according to Embodiment 7 will be described. FIG. 12 is a perspective view of antenna apparatus 10F. FIG. 13 is a plan view of antenna apparatus 10F. FIG. 14 is a side view of antenna apparatus 10F. Note that FIG. 14 is a diagram in which a height of antenna apparatus 10F is increased and antenna apparatus 10F is housed in manhole 100.

Antenna apparatus 10F includes bottom frame 201, leg sections 202, supporting columns 207, upper frame 208, first reinforcing member 220, second reinforcing member 221, antenna elements 13, apparatus attaching plates 240, and handles 250.

Bottom frame 201 has a rectangular frame structure. In four corners of bottom frame 201, holes 210 for fixing leg sections 202 are formed.

Each of four leg sections 202 has grounding section 203, rod 204 vertically extending upward from grounding section 203, and height adjuster 205 which is screwed with a screw groove formed on rod 204 and is movable through rotation in upward and downward directions.

Each rod 204 in each leg section 202 is inserted into each of holes 210 in the corners of bottom frame 201 from above. As shown in FIG. 14, with a bottom surface of bottom frame 201 contacting upper surfaces of height adjusters 205, the bottom frame 201 is supported by the height adjusters 205. By moving positions of height adjusters 205 in upward and downward directions, a height position of bottom frame 201, that is, a height h from upper ends of antenna elements 13 of antenna apparatus 10F up to an upper surface (ground surface) of manhole cover 102 is adjusted. As described above, the height h is adjusted, thereby allowing an electromagnetic field strength of radio waves to be adjusted so as to satisfy the conditions in the radio wave protection guidelines. Nuts (not shown) are screwed from above rods 204, thereby fixing leg sections 202 to bottom frame 201.

For grounding sections 203 of leg sections 202, a rubber material may be used. The rubber material is used for grounding sections 203, thereby allowing transmission of vibration of manhole 100 to antenna apparatus 10F to be inhibited and enabling displacement of a position of antenna apparatus 10F inside the manhole 100 to be inhibited.

Lower ends of four supporting columns 207 are fixed to the four corners of bottom frame 201, respectively and four supporting columns 207 vertically extend upward. As shown in FIG. 12 and FIG. 13, outside surfaces of supporting columns 207 are chamfered in order not to damage an inner wall of manhole 100 when antenna apparatus 10F is housed therein and taken thereout.

Upper frame 208 has a rectangular frame structure which is similar to that of bottom frame 201. Four corners of upper frame 208 are fixed to upper ends of four supporting columns 207.

First reinforcing member 220 is provided on one diagonal line of bottom frame 201, and both ends thereof are fixed to corners or sides of bottom frame 201, respectively. Thus, a frame structure of bottom frame 201 is reinforced.

Second reinforcing member 221 is provided on one diagonal line of upper frame 208, which is in parallel with first reinforcing member 220, and both ends thereof are fixed to corners or sides of upper frame 208. Thus, the frame structure of upper frame 208 is reinforced.

Figure 15:
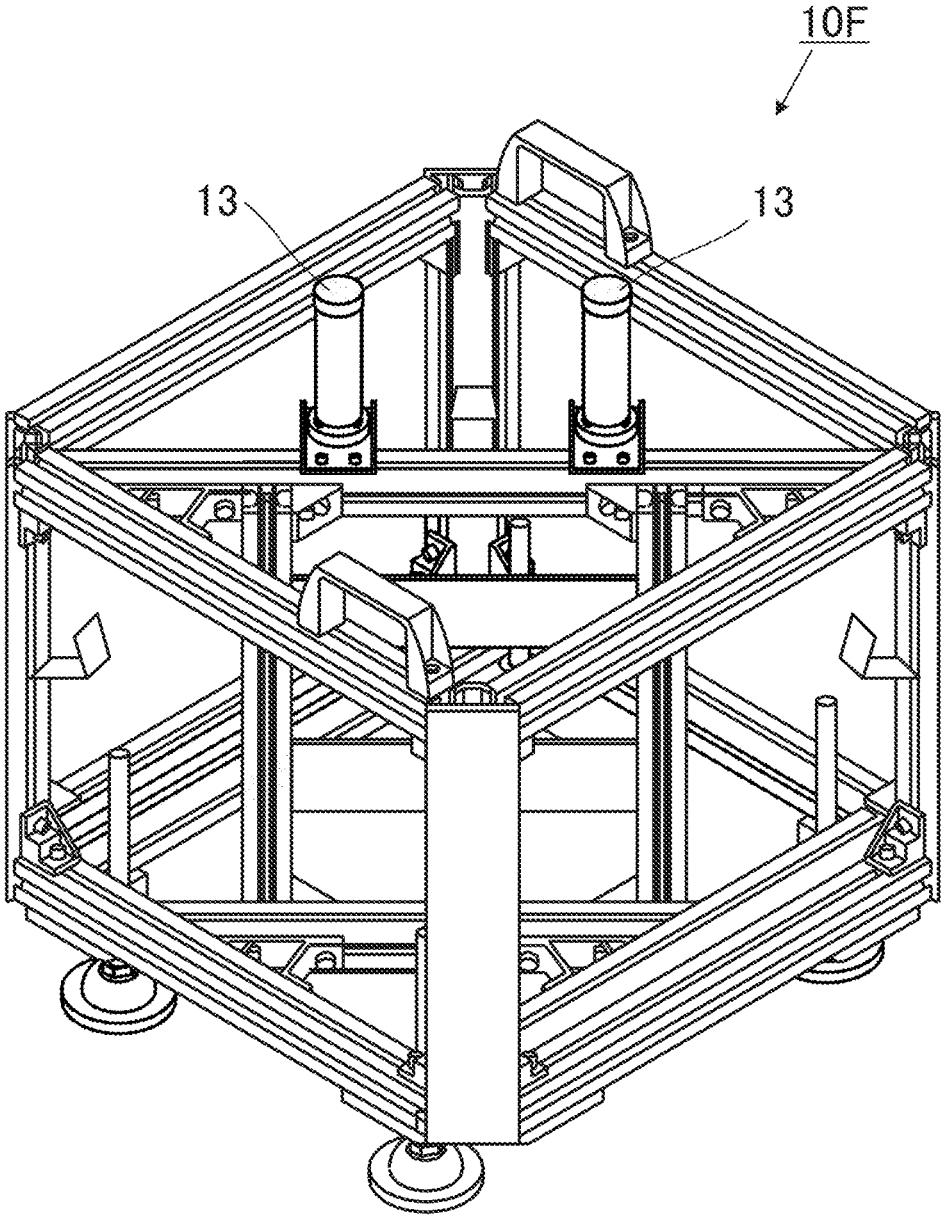
FIG. 15 is a perspective view of the antenna apparatus according to Embodiment 7 in which an interval between antenna elements is changed.

Two antenna elements 13 are installed on second reinforcing member 221 and vertically extend upward. Two antenna elements 13 can be installed on any positions on second reinforcing member 221. For example, as shown in FIG. 15, an interval between two antenna elements can be adjusted.

In addition, a length of second reinforcing member 221 is longer than a length of one side of upper frame 208. Thus, as in the present embodiment, two antenna elements 13 are provided on second reinforcing member 221, thereby allowing a range of movement of two antenna elements 13 to be made larger than that made when two antenna elements 13 are provided on one side of upper frame 208. In other words, the interval between two antenna elements 13 can be more flexibly adjusted.

As described above, on the diagonal line of upper frame 208, second reinforcing member 221 is provided, and on second reinforcing member 221, antenna elements 13 are installed, thereby allowing both of the reinforcement of upper frame 208 and the expansion of the range of movement of antenna elements 13 to be realized.

Figure 16:
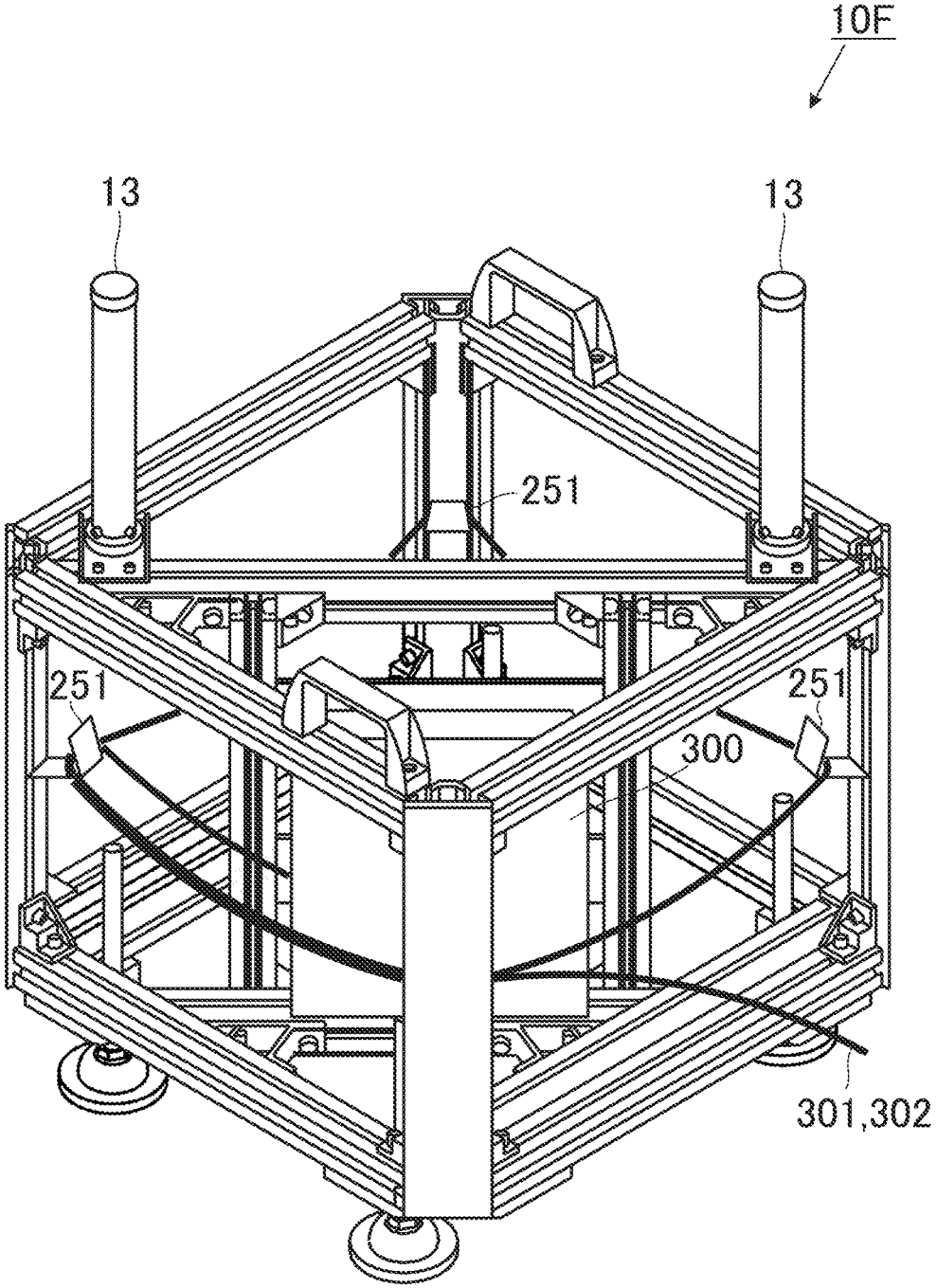
FIG. 16 is a perspective view of the antenna apparatus according to Embodiment 7 in which radio equipment is attached.
Figure 17:
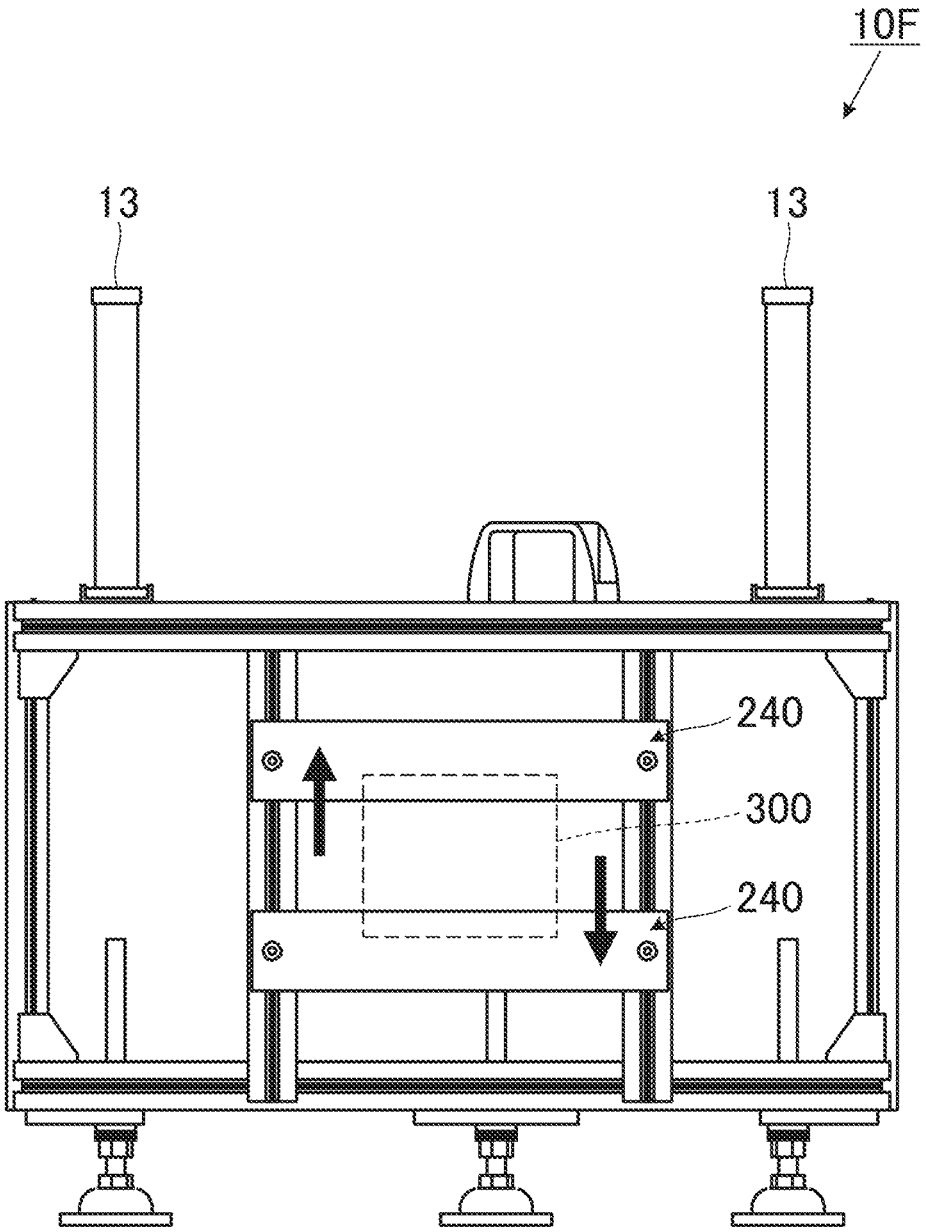
FIG. 17 is a diagram illustrating a portion where the radio equipment of the antenna apparatus according to Embodiment 7 is attached.

One end of each of apparatus attaching plates 240 is fixed to first reinforcing member 220 and the other end each thereof is fixed to second reinforcing member 221. As shown in FIG. 16, on apparatus attaching plates 240, radio equipment (SRE: low power Small optical remote Radio Equipment) 300 is attached. Note that each of apparatus attaching plates 240 may be provided with a mechanism for fixing radio equipment 300. The mechanism may be a slide mechanism. Alternatively, the mechanism may be a fastening mechanism constituted of bolts and nuts. In addition, as shown in FIG. 17, positions of apparatus attaching plates 240 in upward and downward directions may be optionally changeable in accordance with a size of radio equipment 300.

Antenna elements 13 are connected to radio equipment 300 via connector cables (not shown). Note that an assembly in which antenna apparatus 10F is equipped with radio equipment 300 may be called a radio base station.

Two handles 250 are fixed on sides of upper frame 208 which face each other, respectively. Handles 250 are used upon taking antenna apparatus 10F out of manhole 100.

Supporting columns 207 are provided with hooks 251, respectively. Communication cable 301 and electric cable 302 connecting to radio equipment 300 through pipe conduit 105 (refer to FIG. 14) have lengths including allowance in order to allow antenna apparatus 10F to be taken out of manhole 100. Therefore, as shown in FIG. 16, upon housing antenna apparatus 10F in manhole 100, cables 301 and 302 are hooked on hooks 251. Thus, disconnection of cables 301 and 302, caused by entwining, folding, or the like thereof, can be prevented. As shown in FIG. 16, hooks 251 project in directions from supporting columns 207 toward an inside of antenna apparatus 10F. Through this configuration, upon housing antenna apparatus 10F in manhole 100, hooks 251 are not caught to manhole 100. Note, however, that this configuration is one example, hooks 251 may project in directions from supporting columns 207 toward an outside of antenna apparatus 10F, and a configuration other than this configuration may be adopted.

As shown in FIG. 13, a maximum width (a length on the diagonal line) F1 of antenna apparatus 10F may be a length as close to an inner diameter R1 of manhole 100 as possible in a range allowing antenna apparatus 10F to be housed in manhole 100.

Note that first reinforcing member 220 and second reinforcing member 221 are not directly fixed to bottom frame 201, and upper frame 208, respectively, and the components (hereinafter, referred to as "apparatus attachment parts") configured by first reinforcing member 220, second reinforcing member 221, antenna elements 13, and apparatus attaching plates 240 may be configured as described below. In other words, the apparatus attachment parts may have slide mechanisms (not shown) in upward and downward directions. Through this configuration, without taking the whole of antenna apparatus 10F out of manhole 100, the apparatus attachment parts can be taken out of manhole 100. Thus, maintenance work for antenna elements 13 and radio equipment 300 is facilitated. Note that in this case, in order to make a sliding operation of the apparatus attachment parts easy, handles (not shown) may be provided on second reinforcing member 221.

<Configuration Manhole (Handhole)>

Figure 18A:
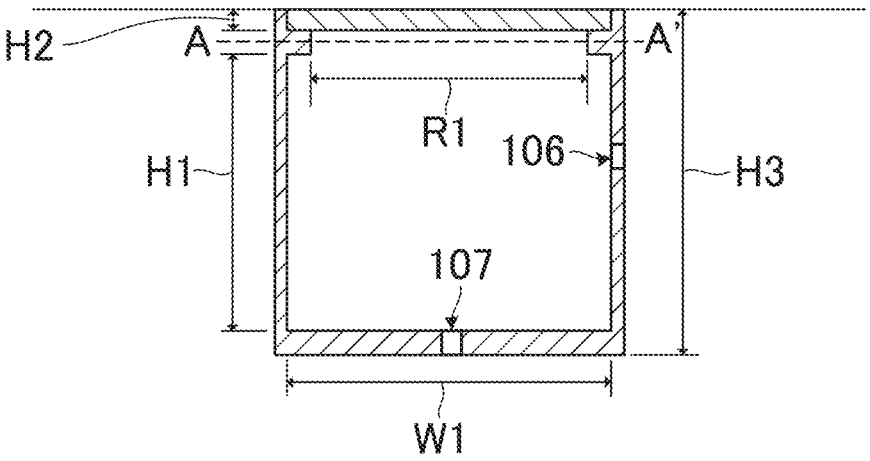
FIG. 18A is a diagram showing an example of a sectional view of a side surface of a manhole according to Embodiment 7.
Figure 18B:
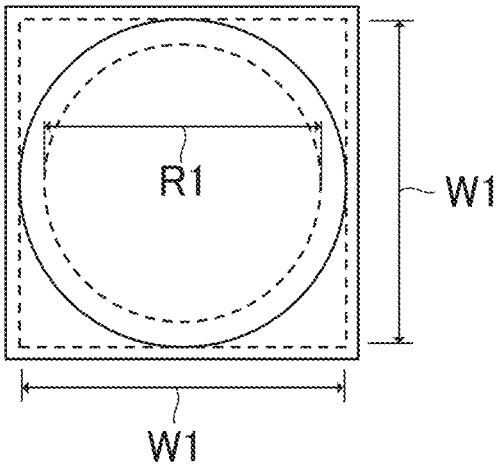
FIG. 18B is a diagram showing an example of a plan view of the manhole according to Embodiment 7.
Figure 18C:
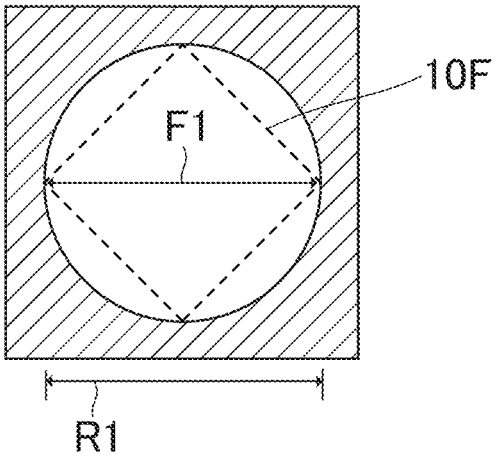
FIG. 18C is a diagram showing an example of a sectional view of the manhole according to Embodiment 7, taken from line A-A'.

FIG. 18A shows an example of a sectional view of a side surface of manhole 100. FIG. 18B shows an example of a plan view of manhole 100. FIG. 18C shows an example of a sectional view, taken from line A-A' in the diagram of manhole 100 shown in FIG. 18A.

A height H1 of an inside of manhole 100 is longer than a height of the whole of antenna apparatus 10F including antenna elements 13. Thus, antenna apparatus 10F can be housed in manhole 100. A height H2 may be, for example, 600 mm.

A thickness H2 of manhole cover 102 is a thickness having a strength causing no problem even when a person, an automobile, or the like gets on manhole cover 102. Note, however, that it is preferable that manhole cover 102 is manufactured by using a material which does not exert any influence on propagation of the radio waves of antenna apparatus 10F installed inside manhole 100. For example, manhole cover 102 may be formed of FRP (Fiber-Reinforced Plastics). In this case, the thickness H2 of manhole cover 102 may be, for example, 50 mm.

A height H3 of the whole of manhole 100 is a size in consideration of the height H1 of the inside of the manhole and the height H2 of manhole cover 102 as mentioned above. For example, the height H3 may be 750 mm.

An inner diameter R1 of a gateway of manhole 100 is, as shown in FIG. 18C, larger than a maximum width F1 (the length of antenna apparatus 10F on the diagonal line) of antenna apparatus 10F. Thus, antenna apparatus 10F can be housed in manhole 100 and can be taken out of manhole 100. The inner diameter R1 may be, for example, 600 mm.

A shape of the inside of manhole 100 may be a cylindrical shape or may be a rectangular parallelepiped shape. In addition, manhole 100 may be formed of the FRP (Fiber-Reinforced Plastics) or may be formed of resin (plastic).

In addition, as shown in FIG. 18A, manhole 100 may be provided with a drain hole 107 formed in a bottom surface thereof. Thus, rain water entering manhole 100 can be permeated (drained) through drain hole 107 into the ground.

In addition, as shown in FIG. 18A, manhole 100 may be provided with through hole 106 formed in a side surface thereof. Through hole 106 is formed at a height at which through hole 106 communicates with pipe conduit 105 shown in FIG. 14 when manhole 100 is embedded in the ground. Through this configuration, through pipe conduit 105 and through hole 106, communication cable 301 and electric cable 302 can be drawn inside manhole 100.

As described above, in manhole 100, antenna apparatus 10F is housed. Accordingly, manhole 100 may be called an antenna apparatus housing body.

<Demonstration Experiment Result>

Figure 19:
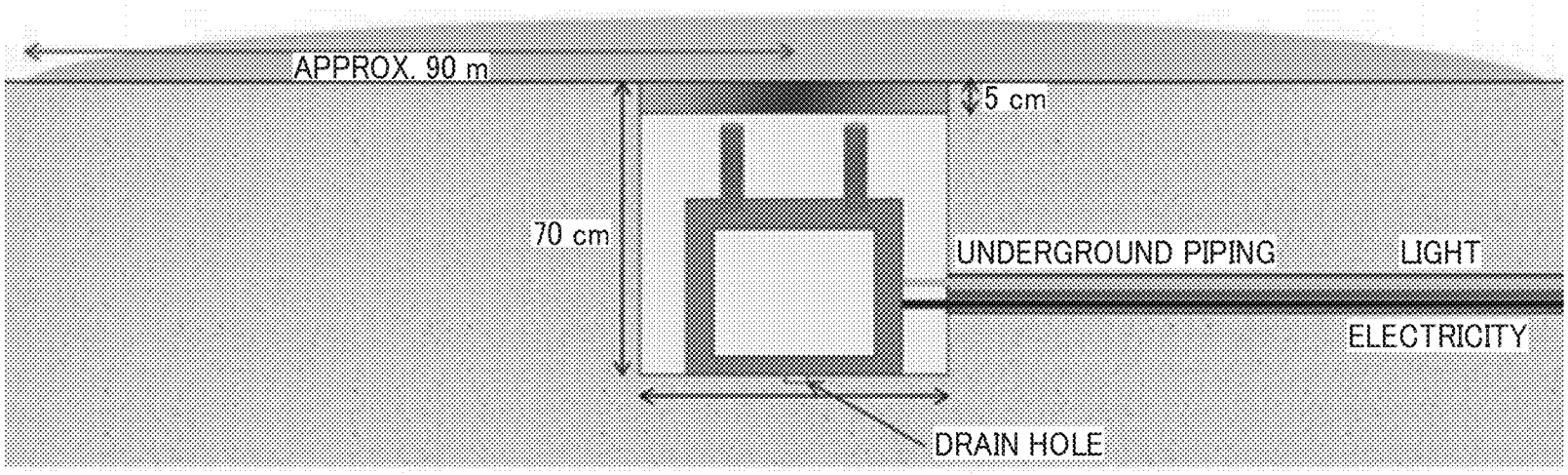
FIG. 19 is a diagram showing a configuration example of a demonstration experiment station according to Embodiment 7.

FIG. 19 is a diagram showing a configuration example of a demonstration experiment station for an antenna apparatus of an underground embedded type.

First, an evaluation method will be described. The demonstration experiment station was installed in a management environment which allowed sufficient isolation from locations, where the general public was able to walk, to be ensured. A configuration of the demonstration experiment station is as shown in FIG. 19. As specifications of the demonstration experiment station, an FDD-LTE system and a frequency band of 1.5 GHz (BAND21) were employed.

Under the conditions, with the center of a surface of a manhole cover as the origin, power densities at specified calculation points in the periphery immediately above the cover were measured.

In order to set each interval among the calculation points in a horizontal direction to specified λ/10 (in this case, 0.02 m) or less and to conduct conservative evaluation, while a measuring instrument set in a MaxHold state was swept, the calculation points at respective heights were scanned in the horizontal direction with a sensor section of the measuring instrument, thereby obtaining a maximum value among measured values of the power densities at the respective heights in the horizontal direction. As a result, it was found out that by increasing a height from antenna elements 13 up to a surface (ground surface) of manhole cover 102, the power density was decreased. In other words, it was found out that by adjusting heights of leg sections 202, it was made possible to adjust an electromagnetic field strength of radio waves so as to satisfy the conditions in the radio wave protection guidelines.

<Countermeasures Against Heat)

When an outdoor temperature is high, a temperature inside manhole 100 is likely to be high. Therefore, for radio equipment 300 of antenna apparatus 10F housed in manhole 100, a cooling section for inhibiting radio equipment 300 from being highly heated may be provided. For example, radio equipment 300 may be covered by a cooling section (housing) having water or a coolant thereinside. Alternatively, a cooling section (sheet) for blocking heat from an outside may be attached onto manhole cover 102.

(Countermeasure Against Water)

Rain water is likely to enter an inside of manhole 100. Therefore, radio equipment 300 of antenna apparatus 10F housed in manhole 100 may be subjected to waterproofing treatment.

Modified Example

In antenna apparatus 10F housed in manhole 100, two or more pieces of radio equipment 300 may be attached. For example, in antenna apparatus 10F housed in manhole 100, radio equipment for LTE and/or 5G and radio equipment (for example, a LoRa master unit) for LPWA (Low Power, Wide Area) may be attached. Thus, since as compared with a case in which a manhole is provided for each radio equipment, the number of manholes can be reduced, an installation cost and a maintenance cost required for the radio equipment can be suppressed.

<Summary of Embodiment 7>

Antenna apparatus 10F according to Embodiment 7 is antenna apparatus 10F of an underground embedded type disposed below manhole cover 102, which includes antenna elements 13 and installation bases (201 and 208) on which antenna elements 13 are installed and which has height adjustment mechanisms (204 and 205) for adjusting a distance from antenna elements 13 to manhole cover 102. Thus, adjustment which satisfies the radio wave protection guidelines and adjustment of a communication area can be made possible. Note that on the installation bases, the two antenna elements may be installed so as to allow a distance between the two antenna elements to be adjusted. In addition, the antenna elements may extend in a direction approaching the manhole cover from the installation bases.

The radio base station according to Embodiment 7 includes the above-described antenna apparatus 10F and radio equipment 300 which is attached on the installation bases of antenna apparatus 10F, is connected to antenna elements 13 by the cables, and performs radio processing for signals transmitted from antenna apparatus 10F and signals received by antenna apparatus 10F. Thus, lengths of the cables connecting radio equipment 300 and antenna elements 13 can be made short, thereby allowing signal attenuation in the cables to be suppressed. Thus, in addition, since radio equipment 300 and antenna apparatus 10F can be housed in manhole 100 in an integrated manner (that is, as the radio base station), installation and maintenance of the radio base station are facilitated. In addition, the installation bases may have hooks 251 for retaining the cables (301 and 302) connected from a backhaul to radio equipment 300. Thus, the cables for the backhaul, which have lengths having the allowance so as to allow the maintenance to be conducted by taking the radio base station out of the manhole, are hooked on hooks 251 upon housing the radio base station in manhole 100 and can be bundled.

The antenna apparatus housing body according to Embodiment 7 includes the container (100) whose upper surface being the closest surface to the ground surface when installed in the ground opens and which is capable of housing the above-described antenna apparatus 10F and the cover (102) which is formed of the FRP (Fiber-Reinforced Plastics) and covers an opening of the container. Thus, without exerting any influence on the propagation of the radio waves of antenna apparatus 10F housed, a high load resistant strength can be obtained. In addition, the container may be provided with the drain hole (107) formed in the lower surface and the through hole (106) formed in the side surface. Thus, the rain water entering manhole 100 can be drained. In addition, the cables (301 and 302) for the backhaul can be drawn inside the container and be connected to radio equipment 300.

The above-described Embodiments are illustrative for the description of the present invention, and it is not intended that the scope of the present invention is limited merely to the Embodiments. Those skilled in the art can implement the present invention in other various modes without departing from the gist of the present invention.

For example, although in each of the above-described Embodiments, the example in which the number of antenna elements 13 is two is illustrated, the number of antenna elements 13 may be one or may be three or more.

REFERENCE SIGNS LIST

10, 10A, 10B, 10C, 10D, 10E, 10F. Antenna Apparatus
11 Supporting Section
12, 12B, 12C, 12D, 12E Antenna Base
13 Antenna Element
14 Antenna Angle Adjustment Mechanism
15 Antenna Height Adjustment Mechanism
16 Connector Cable
20 Pedestal
21 Leg Section
22 Supporting Column
23 Height Adjuster
24 Intermediate Member
25A, 25B, 25C Buffer Section
26 Rod
31 Cylindrical Section
32 Fixture
33 Circular Ring Section
34 Cylindrical Section
35 Reinforcing Plate
36 Bracket
41 First Supporting Column
42 Second Supporting Column
46 Stopper
47 Pin
51 Supporting Column

52 Intermediate Member
61 Handle Section
62 Shaft Section
63 Bearing Section
64 Guide Section
71 Handle Section
100 Manhole (Handhole)
102 Manhole Cover
106 Through Hole
107 Drain Hole
201 Bottom Frame
202 Leg Section
203 Grounding Section
204 Rod
205 Adjuster
207 Supporting Column
208 Upper Frame
210 Hole
240 Apparatus Attaching Plate
250 Handle
251 Hook
300 Radio Equipment
301 Communication Cable
302 Electric Cable

The invention claimed is:

1. An antenna apparatus comprising:

an antenna element;

an installation base being a base where the antenna element is installed;

a container including an upper surface that opens and housing the antenna element and the installation base, the upper surface being a surface closest to a ground surface when the container is installed in a ground; and a cover being formed of FRP (Fiber-Reinforced Plastics) and covering an opening of the container, wherein the installation base includes a height adjustment mechanism that adjusts a distance from the antenna element to the cover.

2. The antenna apparatus according to claim 1, wherein a second antenna element is installed to the installation base in such a manner that a distance between the antenna element and the second antenna element is adjustable.

3. The antenna apparatus according to claim 1, wherein the antenna element extends from the installation base in a direction approaching the cover.

4. The antenna apparatus according to claim 1, wherein a drain hole is formed in a lower surface of the container and a through hole is formed in a side surface of the container when the container is installed in a ground.

5. A radio base station comprising:

the antenna apparatus according to claim 4; and a radio equipment installed to the installation base and connected to the antenna element by a cable, the radio equipment being configured to perform radio processing for a signal transmitted from the antenna apparatus and for a signal received by the antenna apparatus, wherein the installation base is provided with two grasps and hooks, each of the hooks protrudes from one of supporting columns of the installation base in the direction of the inside of the installation base, and the cable connected from the backhaul to the radio equipment through the through hole are grouped together over the hooks.

* * * * *